US012729622B2

(12) United States Patent
Gordon et al.

(10) Patent No.: US 12,729,622 B2
(45) Date of Patent: Sep. 8, 2026

(54) FLUID DIVERTER

(71) Applicant: Sentinel Subsea Ltd, Elgin (GB)

(72) Inventors: Neil Gordon, Elgin (GB); Andrew Jaffrey, Elgin (GB)

(73) Assignee: Sentinel Subsea Ltd., Elgin (GB)

( * ) Notice: Subject to any disclaimer, the term of this patent is extended or adjusted under 35 U.S.C. 154(b) by 0 days.

(21) Appl. No.: 18/837,261

(22) PCT Filed: Feb. 15, 2023

(86) PCT No.: PCT/GB2023/050341
§ 371 (c)(1),
(2) Date: Aug. 9, 2024

(87) PCT Pub. No.: WO2023/156770
PCT Pub. Date: Aug. 24, 2023

(65) Prior Publication Data

US 2025/0146405 A1 May 8, 2025

(30) Foreign Application Priority Data

Feb. 17, 2022 (GB) ..... 2202115
Feb. 17, 2022 (GB) ..... 2202116

(51) Int. Cl.
*E21B 47/11* (2012.01)
*E21B 47/001* (2012.01)

(52) U.S. Cl.
CPC ..... *E21B 47/11* (2020.05); *E21B 47/001* (2020.05)

(58) Field of Classification Search
CPC ..... E21B 47/11; E21B 47/001
See application file for complete search history.

(56) References Cited

U.S. PATENT DOCUMENTS 6,578,405 B2 * 6/2003 Kleinberg ..... G01V 9/007 73/19.01
8,398,334 B1 * 3/2013 Doyle ..... E02B 15/04 405/64

(Continued)

FOREIGN PATENT DOCUMENTS

EP 0519689 A2 12/1992
EP 0519689 A3 12/1992

(Continued)

OTHER PUBLICATIONS

Combined Search and Examination Report in Foreign Document No. GB22021158; Publication Date: Apr. 6, 2022.

(Continued)

*Primary Examiner* — James G Sayre
(74) *Attorney, Agent, or Firm* — Feeney IP Law; Daniel W. Sullivan; Alan F. Feeney

(57) ABSTRACT

An apparatus for monitoring the integrity of a subsea well or a fluid sequestration site by detecting the presence of a first predetermined chemical in a volume of fluid being released at a flow rate in excess of a threshold value is provided. In one embodiment, the apparatus detects the presence of a predetermined chemical in a volume of fluid only when the flow rate of the fluid exceeds a threshold value. Restricting the fluid's flow based on its flow rate can enable the system to ignore low-level/background emissions of a fluid including a chemical, thereby avoiding unintended triggering of a detector. Once the flow rate exceeds the threshold, as will be indicative of a failure of a subsea well, the detector can receive a sufficient quantity of the fluid including the chemical for detection.

20 Claims, 25 Drawing Sheets

(56) References Cited

U.S. PATENT DOCUMENTS

| | | | | |
|---|---|---|---|---|
| 9,909,948 | B1 * | 3/2018 | Stewart | E21B 47/117 |
| 2012/0051841 | A1 * | 3/2012 | Hatton | E21B 43/0122 405/63 |
| 2015/0285060 | A1 * | 10/2015 | Albinsson | E21B 43/01 166/337 |
| 2016/0230490 | A1 | 8/2016 | Samuelson | |
| 2016/0376866 | A1 | 12/2016 | Donald | |
| 2018/0274359 | A1 | 9/2018 | Bondarenko | |
| 2020/0208496 | A1 * | 7/2020 | Veselka | E21B 43/086 |

FOREIGN PATENT DOCUMENTS

| | | | | |
|---|---|---|---|---|
| GB | 2493366 | A1 | 8/2011 | |
| GB | 2493366 | A * | 2/2013 | E21B 47/107 |
| GB | 2573661 | B1 | 9/2020 | |
| WO | WO2001094740 | A1 | 12/2001 | |
| WO | WO2019215438 | A1 | 11/2019 | |
| WO | WO2021071880 | A1 | 4/2021 | |

OTHER PUBLICATIONS

Notification of Intention to Grant in Foreign Document No. GB22021158; Publication Date: Dec. 7, 2023.

Combined Search and Examination Report in Foreign Document No. GB22021166; Publication Date: Mar. 7, 2022.

Notification of Intention to Grant in Foreign Document No. GB22021166; Publication Date: Dec. 7, 2023.

International Search Report in Foreign Patent Document No. PCT/GB2023/050341.

* cited by examiner pressure = p.g.h

Sea water, p = 1,035 kg/m³ g = 9.81 m/s²

| | metres | feet | Pa | Pressure psi | bar | number of coins £1 | 2p |
|---|---|---|---|---|---|---|---|
| d2 or d4 | 30.000 | 98.4252 | 304,600.500 | 44.17857 | 3.0460 | | |
| d1 or d3 | 30.100 | 98.7533 | 305,615.835 | 44.32583 | 3.0562 | | |
| delta | 0.100 | 0.328 | 1,015.335 | 0.14726 | 0.0101533 | 6 | 8 |

| | metres | feet | Pa | Pressure psi | bar | | |
|---|---|---|---|---|---|---|---|
| d2 or d4 | 30.000 | 98.4252 | 304,600.500 | 44.17857 | 3.0460 | | |
| d1 or d3 | 30.200 | 99.0814 | 306,631.170 | 44.47309 | 3.0663 | | |
| delta | 0.200 | 0.656 | 2,030.670 | 0.29452 | 0.0203067 | 10 | 16 |

| | metres | feet | Pa | Pressure psi | bar | | |
|---|---|---|---|---|---|---|---|
| d2 or d4 | 30.000 | 98.4252 | 304,600.500 | 44.17857 | 3.0460 | | |
| d1 or d3 | 30.300 | 99.4094 | 307,646.505 | 44.62035 | 3.0765 | | |
| delta | 0.300 | 0.984 | 3,046.005 | 0.44179 | 0.0304600 | 16 | 23 |

| | metres | feet | Pa | Pressure psi | bar | | |
|---|---|---|---|---|---|---|---|
| d2 or d4 | 30.000 | 98.4252 | 304,600.500 | 44.17857 | 3.0460 | | |
| d1 or d3 | 30.400 | 99.7375 | 308,661.840 | 44.76762 | 3.0866 | | |
| delta | 0.400 | 1.312 | 4,061.340 | 0.58905 | 0.0406134 | 21 | 31 |

| | metres | feet | Pa | Pressure psi | bar | | |
|---|---|---|---|---|---|---|---|
| d2 or d4 | 30.000 | 98.4252 | 304,600.500 | 44.17857 | 3.0460 | | |
| d1 or d3 | 30.500 | 100.0656 | 309,677.175 | 44.91488 | 3.0968 | | |
| delta | 0.500 | 1.640 | 5,076.675 | 0.73631 | 0.0507667 | 26 | 39 |

Conversions

| | | | |
|---|---|---|---|
| 1 mmHg | = | 0.0193368 | psi |
| 1 psi | = | 51.7149 | mmHg |
| 1 psi | = | 6894.76 | Pa |
| 1 Pa | = | 0.000145 | psi |
| 1 bar | = | 14.5037738 | psi |
| 1 psi | = | 0.068947573 | bar |
| 1 mmHg | = | 133.32254 | pa |
| 1 Pa | = | 0.0075006 | mmHg |
| 1 lb | = | 453.59237 | g |

£1 coin * = 8.75 g * - new style 23.43 = dia of £1 coin [mm]

431.2 = area of £1 coin [mm^2] 647.7 mm in 1 square inch 51.84 x £1 coins per 1 lb pro-rata = 34.51 x £1 coins for 1 psi 2p coin = 7.12 g 25.9 = dia of 2 p coin [mm]

526.9 = area of 2 p coin [mm^2] 647.7 mm in 1 square inch 63.71 x 2 p coins per 1 lb pro-rata = 51.82 x 2 p coins for 1 psi

Figure 15

FLUID DIVERTER

CROSS-REFERENCE TO RELATED APPLICATIONS

The application claims the benefit of PCT International Application No. PCT/GB2023/050341 filed Feb. 15, 2023, which claims the benefit of GB Patent Application No. 2202115.8 filed Feb. 17, 2022, and GB Patent Application No. 2202116.6 filed Feb. 17, 2022, the entire disclosures of which are hereby incorporated by reference.

FIELD OF THE INVENTION

The present disclosure relates to an apparatus for monitoring the integrity of a subsea well or a fluid sequestration site.

The present disclosure relates to an apparatus comprising a fluid control unit for restricting the flow of the volume of a fluid until its flow rate exceeds a threshold value.

BACKGROUND

FIG. 1(*a*) is a schematic of a subsea hydrocarbon well apparatus 5 as is known in the prior art (WO 2019/215438). The apparatus 5, e.g. a drilling system or a production system, facilitates access to or extraction of a resource, such as oil or natural gas, from a sub-surface reservoir 35 through a well 40. The apparatus 5 is generally depicted as an offshore drilling apparatus 5 including a drilling rig 10 on the sea surface 6, coupled with a riser 15 to a blowout preventer (BOP) 20 and a wellhead assembly 25 installed at the well 40. The wellhead assembly is located on the seabed 30 and is connected to a sub-surface 35 casing scheme 45 previously installed for the purpose of producing hydrocarbons.

At the end of the productive life of a subsea oil or gas well, there is typically a requirement to make the well safe and to remove production-related infrastructure from the seabed. Several techniques exist and are under development for the sequence of activities generally referred to as decommissioning a well, including Plugging and Abandonment (P&A). These activities might include creating multiple barriers between the sub-surface reservoir (which might be a considerable distance below the seabed) and the wellhead location on the seabed through which previous drilling and production activities have been performed.

FIG. 1(*b*) is a schematic of a decommissioned well 101 as is known in the prior art (WO 2019/215438). In the schematic there is shown a mechanical bridge plug 80, a cement plug 85, a volume of kill fluid 90, a mechanical bridge plug 95, a cement plug 100, a volume of kill fluid 105, a mechanical bridge plug 110, and a cement plug 115.

Although multiple barriers are created during decommissioning between a reservoir and the external environment, there are multiple potential leak paths that can result from processes including corrosion of the metalwork such as the casing and/or deformation caused by geological movement. Examples of potential leak paths include mico-annuli at the interface between casing and cement caused by channels and the presence of materials such as wax, scale, oil and dirt; connected pores, cracks and channels caused by permeability in cement; and through perforations of casing caused by corrosion and mechanical deformation.

Such leak paths may occur at any depth within the well arrangement and give rise to the propagation or migration of hydrocarbons 130 through the sub-surface geology 35. The sub-surface post-decommissioning leak path example 120 shown in FIG. 1(*b*) may give rise to leaked material 135 emerging from the seabed 30 into the subsea environment. Whereas leaks may occur along the axis of the pre-decommissioned well bore 125, they may also remain close to the casing scheme or take any other path of least resistance to the seabed 30 such as paths 130.

Upon completion of well decommissioning activities, it may therefore be desirable to monitor the environment around a well site for an extended period to provide reassurance that a well's integrity is secure and that hydrocarbons from the reservoir are not leaking into the subsea environment. Several conventional systems are currently available to address this requirement, using approaches including active acoustics, bio sensors, capacitance, fibre optics, fluorescence, optical sniffers, optical cameras and passive acoustics.

An example of a leak from a reservoir is shown in FIG. 1(*b*) where leak paths 130 are related to breaches of well barriers, but path 131 is not, as it occurs below the first barrier 80 and thus originates within the reservoir (being the material previously installed by the bull heading procedure).

WO 2019/215438 describes a passive detection system for use in monitoring the integrity of abandoned, suspended and/or decommissioned subsea wells or carbon dioxide sequestration reservoirs. Such a system can achieve differentiation of the source of a leak thus minimising the probability of false alarms. This is achieved by using a tracer fluid 145 that is mixed with well kill fluid 90, 105 so that the presence and detection of said tracer fluid 145 in the external environment means it can only have come from within a well which has suffered a loss of integrity.

An example of this tracer fluid 145 is referred to as Sentinel Well Integrity Fluid Tracer (SWIFT) 145, available from Sentinel Subsea Limited of Aberdeen, UK. This fluid 145 may be supplied in concentrated or diluted form, pre-mixed with well kill fluid 90, 105 or added to kill fluid 90, 105 as the fluid 90, 105, 145 is pumped into a well during decommissioning activity.

It is desirable that SWIFT 145 has the following properties: it is not a naturally occurring material, so that it cannot be mistaken for any other substance, compound, fluid or particle that would be found in the subsea environment; it is inert with any material that might be in the well, e.g. cement, steel, alloys and casing; it is environmentally benign and does not pose a risk to human handlers.

There are multiple mechanisms by which SWIFT 145 may migrate from a kill fluid 90, 105 zone into a subsea environment. For example, rising naturally through any available leak path 130 in the same way as reservoir hydrocarbons; driven by reservoir pressure, i.e. by the force of the hydrocarbons leaking from the reservoir past the installed barriers; or chemically or mechanically liberated from the kill fluid 90, 105 as it comes into contact with leaking hydrocarbons, at which point SWIFT 145 is optionally bound chemically or mechanically to the hydrocarbons leaking from the reservoir past the barriers and carried to the subsea environment in combination with the hydrocarbons. Preferably SWIFT 145, or the material of interest that is being monitored, is less dense than water/sea water (or less dense than the sea water in the vicinity of the seabed where the monitoring apparatus is positioned), and therefore has a natural tendency to rise under its own inherent buoyancy.

The system disclosed in WO 2019/215438 provides passive monitoring of SWIFT 145 (or other predetermined chemicals that will provide the required properties to alert an operator to a loss of well integrity in the subsea environment). Whereas active monitoring systems are available to detect the presence of hydrocarbons or tracer fluids using a myriad of techniques, these generally require the use of active systems (therefore electrical power), sensors, processors and communication channels.

The passive detection of SWIFT 145 (or other appropriate predetermined chemical) is achieved by the use of one or more materials that react to the presence of SWIFT 145 (or other predetermined material) and thus provide a detection mechanism.

The passive detection of SWIFT 145 is achieved by the use of one or more materials that react to the presence of SWIFT 145. Several example embodiments are presented in WO 2019/215438.

FIG. 1(*c*) is a schematic of a beacon release mechanism 200 that is triggered upon interaction with SWIFT 145 (or other pre-determined chemical) thereby providing a mechanism for alerting an operator to a leak from a decommissioned well, such as the well 101 shown in FIG. 1(*b*) (WO 2019/215438).

In this example, the beacon release mechanism 200 attachment bracket is a simple ring 280 and the assembly is prevented from moving under buoyancy force 275 by trigger rod 285. In this embodiment, the trigger rod 285 directly restrains the beacon assembly 265 and the failure of the trigger rod 285, upon completion of a reaction and degradation process when the trigger rod 285 is in contact with SWIFT 145 (or another predetermined chemical), allows the beacon assembly 265 to ascend. When the beacon release mechanism 265 reaches the sea surface it may then notify an operator that there is a leak from the well 101.

In summary, the systems presented in WO 2019/215438 and illustrated in FIGS. 1(*b*) and 1(*c*) operate by gathering fluids of interest (liquid or gas) and directing these fluids to a chamber where they interact with and degrade trigger materials that restrain a buoyant beacon. However, the trigger material can be subject to degradation upon contact with only low levels of a predetermined chemical or upon contact with background emissions (such as naturally occur from the seabed). Therefore, such a system may erroneously alert a user to a failure of a decommissioned well system.

SUMMARY

It is desirable to provide a system that can monitor the integrity of a subsea well or a fluid sequestration site and provide a mitigation of potentially erroneous alerts when compared to prior art systems.

Furthermore, it is desirable to provide a passive means of mitigating against potentially erroneous alerts, thereby avoiding the energy and maintenance requirements as may be needed from active systems.

It is desirable to provide a compact and robust system for controlling the flow of a fluid. Such a system will have benefits in any field where it is desirable to control the flow of fluid and is not limited to the field of monitoring the integrity of a subsea well or a fluid sequestration site.

According to a first aspect of the disclosure there is provided an apparatus for monitoring the integrity of a subsea well or a fluid sequestration site by detecting the presence of a first predetermined chemical in a volume of fluid being released at a flow rate in excess of a threshold value, the apparatus comprising a detection unit configured to detect the first predetermined chemical, and a fluid control unit configured to capture the volume of fluid, direct the volume fluid to the detection unit, and restrict the flow of the volume of fluid to the detection unit until its flow rate exceeds a threshold value.

Optionally, the detection unit is configured to detect the first predetermined chemical by reacting to contact with the first predetermined chemical.

Optionally, the apparatus comprises a signalling device, wherein the detection unit is configured to activate the signalling device in response to the detection of the first predetermined chemical.

Optionally, the signalling device comprises at least one beacon configured to transmit a signal to alert an operator to a loss of integrity in the subsea well of fluid sequestration site upon activation of the signalling device.

Optionally, the beacon is configured to transmit the signal to the operator via a satellite.

Optionally, the detection unit comprises a first material that is configured to degrade in response to contact with the first predetermined chemical, thereby reacting to contact with the first predetermined chemical.

Optionally, the apparatus comprises a signalling device, wherein the detection unit is configured to activate the signalling device in response to the degradation of the first material.

Optionally, the detection unit is configured to activate the signalling device in response to the degradation of the first material by having the loss of structural integrity of the first material initiate the release of the signalling device.

Optionally, the signalling device comprises a buoyant component such that the signalling device is configured to rise to the water surface upon its release.

Optionally, the signalling device comprises at least one beacon configured to transmit a signal to alert an operator to a loss of integrity in the subsea well or fluid sequestration site upon activation of the signalling device.

Optionally, the beacon is configured to transmit the signal to the operator via a satellite.

Optionally, the detection unit comprises a secondary fluid configured to protect the first material from degradation prior to use.

Optionally, the fluid control unit comprises an input portion arranged to capture the volume of fluid, an output portion arranged to provide the volume of fluid to the detection unit, and a fluid path portion positioned therebetween, the fluid path portion being arranged to direct the volume of fluid from the input portion to the output portion.

Optionally, the fluid path portion comprises a flow restriction component to restrict the flow of the volume of fluid to the detection unit until its flow rate exceeds the threshold value.

Optionally, the flow restriction component comprises an aperture to provide a fluid passage from an interior of the fluid control unit to an exterior of the fluid control unit, thereby permitting the passage of at least a portion of the volume of fluid from the interior of the fluid control unit to the exterior of the fluid control unit.

Optionally, the threshold value is dependent on the size of the aperture and/or a vertical position of the aperture when in use.

Optionally, the size of the aperture and/or the vertical position of the aperture is adjustable.

Optionally, the aperture is positioned in an upward facing surface of the fluid control unit when in use.

Optionally, the apparatus comprises a first conduit wherein the aperture is coupled to the first conduit thereby providing the fluid passage from the interior of the fluid control unit to the exterior of the fluid control unit.

Optionally, a first end of the first conduit at the aperture is at a first depth, and a second end of the first conduit is at a second depth.

Optionally, the second depth is less than the first depth.

Optionally, the detection unit comprises one or more vents arranged to permit the passage of fluids.

Optionally, the apparatus comprises a second conduit wherein one of the vents is coupled to the second conduit, and a first end of the second conduit is at a third depth and a second end of the second conduit is at a fourth depth.

Optionally, the fourth depth is less than the third depth.

Optionally, the fluid path portion comprises a first portion, a second portion and a flow redirect portion, and the fluid path portion is arranged to provide a main fluid path from the input portion to the first portion, from the first portion to the flow redirect portion, from the flow redirect portion to the second portion, and from the second portion to the output portion.

Optionally, the flow redirect portion is arranged to redirect the main fluid path.

Optionally, the fluid path portion comprises an s-bend comprising the first portion, the second portion and the flow redirect portion.

Optionally, the fluid path portion comprises a flow restriction component to restrict the flow of the volume of fluid to the detection unit until its flow rate exceeds the threshold value.

Optionally, the flow restriction component comprises an aperture to provide a fluid passage from an interior of the fluid control unit to an exterior of the fluid control unit, thereby permitting the passage of at least a portion of the volume of fluid from the interior of the fluid control unit to the exterior of the fluid control unit.

Optionally, the threshold value is dependent on the size of the aperture and/or a vertical position of the aperture when in use.

Optionally, the size of the aperture and/or the vertical position of the aperture is adjustable.

Optionally, the aperture is positioned in an upward facing surface of the fluid control unit when in use.

Optionally, the aperture is positioned in the flow redirect portion.

Optionally, the apparatus comprises a first conduit wherein the aperture is coupled to the first conduit thereby providing the fluid passage from the interior of the fluid control unit to the exterior of the fluid control unit.

Optionally, a first end of the first conduit at the aperture is at a first depth, and a second end of the first conduit is at a second depth.

Optionally, the second depth is less than the first depth.

Optionally, the detection unit comprises one or more vents arranged to permit the passage of fluids.

Optionally, the apparatus comprises a second conduit wherein one of the vents is coupled to the second conduit, and a first end of the second conduit is at a third depth and a second end of the second conduit is at a fourth depth.

Optionally, the fourth depth is less than the third depth.

Optionally, the flow redirect portion and the second portion are coupled via at least one orifice to provide an additional fluid path between the flow redirect portion and the second portion.

Optionally, the additional fluid path between the flow redirect portion and the second portion is positioned above the main fluid path between the flow redirect portion and the second portion when in use.

Optionally, the flow redirect portion and the second portion each comprise an orifice, and the fluid control unit comprises an additional flow conduit coupled to the two orifices, thereby providing the additional fluid path between said orifices.

Optionally, the orifices of the second portion are positioned above the orifice of the flow redirect portion when in use.

Optionally, the s-bend comprises a flapper valve.

Optionally, the first predetermined chemical is a tracer fluid, or carbon dioxide, or hydrogen, or one or more hydrocarbons.

Optionally, the fluid control unit comprises a first unit enclosing a first volume and arranged to capture the volume of fluid within the first volume and to provide the volume of fluid to a second volume, and a second unit at least partially enclosing the first unit and enclosing the second volume and arranged to provide the volume of fluid from the second volume to a third volume, wherein the fluid control unit is configured to restrict the passage of the volume of fluid to the third volume until the flow rate of the volume of fluid exceeds a threshold value, and the detection unit is configured to detect the presence of the first predetermined chemical within in the third volume.

Optionally, the second volume is exterior to the first unit.

Optionally, the third volume is exterior to the first unit and the second unit.

Optionally, one or both of the first and second units are substantially cylindrical.

Optionally, the first unit comprises a first orifice arranged to permit the passage of the volume of fluid from an exterior of the first unit to the first volume, thereby capturing the volume of fluid within the first volume, and a second orifice arranged to permit the passage of the volume of the fluid from the first volume to the second volume, thereby redirecting the flow of the volume of fluid.

Optionally, the position of the second orifice on the first unit is adjustable.

Optionally, the first unit is configured to permit the adjustment of the position of the second orifice on the first unit.

Optionally, the first unit comprises a first inner cylinder and a first outer cylinder, the first inner cylinder being positioned at least partially within the first outer cylinder.

Optionally, an outer surface of the first inner cylinder is in physical contact with an inner surface of the first outer cylinder.

Optionally, the first inner cylinder comprises a first inner cylinder aperture, the first outer cylinder comprises a first outer cylinder aperture, wherein the apertures of the respective cylinders are arranged to partially overlap thereby forming the second orifice.

Optionally, the position at which the apertures of the first inner cylinder and the first outer cylinder partially overlap is adjustable, thereby permitting the adjustment of the position of the second orifice on the first unit.

Optionally, the first inner cylinder and/or the first outer cylinder is configured to be rotatable, wherein the position of the second orifice is controlled by the relative rotation of the first inner cylinder and the first outer cylinder.

Optionally, the first inner cylinder aperture is a slot and/or the first outer cylinder aperture is a slot.

Optionally, one of the first inner cylinder aperture and the first outer cylinder aperture is a vertical slot and the other of the first inner cylinder aperture and the first outer cylinder aperture is an angled slot.

Optionally, the second unit comprises a third orifice arranged to permit the passage of the volume of fluid from the second volume to the third volume, thereby redirecting the flow of the volume of fluid.

Optionally, the third orifice is at a greater depth than the second orifice when in use.

Optionally, the second unit comprises a fourth orifice arranged to permit the passage of the volume of fluid from the second volume to the third volume, thereby redirecting the flow of the volume of fluid, the third orifice being at a greater depth than the fourth orifice when in use.

Optionally, the position of the third orifice and/or fourth orifice on the second unit is adjustable.

Optionally, the second unit is configured to permit the adjustment of the position of the third orifice and/or fourth orifice on the second unit.

Optionally, the second unit comprises a second inner cylinder and a second outer cylinder, the second inner cylinder being positioned at least partially within the second outer cylinder.

Optionally, an outer surface of the second inner cylinder is in physical contact with an inner surface of the second outer cylinder.

Optionally, the second inner cylinder comprises a second inner cylinder aperture, the second outer cylinder comprises a second outer cylinder aperture, wherein the apertures of the respective cylinders are arranged to partially overlap thereby forming the third orifice and/or the fourth orifice.

Optionally, the position at which the apertures of the second inner cylinder and the second inner cylinder partially overlap is adjustable, thereby permitting the adjustment of the position of the third orifice and/or the fourth orifice on the second unit.

Optionally, the second inner cylinder and/or the second outer cylinder is configured to be rotatable, wherein the position of the third orifice and/or the fourth orifice is controlled by the relative rotation of the second inner cylinder and the second outer cylinder.

Optionally, the second inner cylinder aperture is a slot and/or the second outer cylinder aperture is a slot.

Optionally, one of the second inner cylinder aperture and the second outer cylinder aperture is a vertical slot and the other of the second inner cylinder aperture and the second outer cylinder aperture is an angled slot.

Optionally, the fluid control unit comprises a flow restriction component arranged to restrict the passage of the volume of fluid to the third volume until its flow rate exceeds the threshold value.

Optionally, the second unit comprises the flow restriction component.

Optionally, the flow restriction component comprises an aperture to provide a fluid passage from the second volume of the fluid control unit to an exterior of the fluid control unit, thereby permitting the passage of at least a portion of the volume of the fluid to the exterior of the fluid control unit.

Optionally, the flow restriction component comprises a conduit coupled to the aperture to provide the fluid passage from the second volume of the fluid control unit to the exterior of the fluid control unit, thereby permitting the passage of at least a portion of the volume of the fluid to the exterior of the fluid control unit.

Optionally, the threshold value is dependent on the size of the aperture and/or a vertical position of the aperture when in use and/or the size of the conduit.

Optionally, the size of the aperture and/or the vertical position of the aperture and/or the size of the conduit is adjustable.

Optionally, the third orifice is positioned at a greater depth than an outlet of the conduit when in use.

Optionally, the fluid control unit is configured to restrict the passage of the volume of fluid to the third volume via a first path until the flow rate of the volume of fluid exceeds a threshold value Optionally, the first path is provided by at least one of the third and fourth orifices.

Optionally, the fluid control unit is configured to provide the volume of fluid to the third volume via a second path if the quantity of the first predetermined chemical passing through at least a portion of the fluid control unit exceeds a threshold quantity.

Optionally, the fluid control unit comprises a fifth orifice, the fifth orifice providing the second path.

Optionally, the fifth orifice is closed by a plug comprising a second material that degrades in the presence of the first predetermined chemical.

Optionally, the plug is arranged to degrade to a sufficient degree to permit passage of the volume of fluid into the third volume via the fifth orifice when the quantity of the first predetermined chemical passing through and contacting the plug exceeds the threshold quantity.

Optionally, the second unit comprises the fifth orifice and the plug.

Optionally, the fifth orifice and the plug are in an upper surface of the second unit.

Optionally, the fluid control unit comprises a third unit at least partially enclosing the first unit and/or at least partially enclosing the second unit.

Optionally, the third unit is arranged to direct the flow of the volume of fluid upwards when in use.

Optionally, the third unit is arranged to direct the flow of the volume of fluid towards the third volume.

Optionally, the third unit encloses the third volume.

Optionally, the first predetermined chemical is a tracer fluid, or hydrogen, or carbon dioxide, or one or more hydrocarbons.

Optionally, the first predetermined chemical is a liquid hydrocarbon.

Optionally, the first predetermined chemical is oil.

Optionally, the volume of fluid comprises a second predetermined chemical.

Optionally, the plug does not degrade substantially, or at all, in the presence of the second predetermined chemical.

Optionally, the second predetermined chemical is a gas hydrocarbon, or hydrogen, or carbon dioxide.

Optionally, the apparatus comprises a fluid collection unit configured to collect the volume of fluid, and provide the volume of fluid to the fluid control unit.

Optionally, the fluid collection unit is attachable to the subsea well.

Optionally, the fluid collection unit comprises two or more collection components arranged to collect fluid over different areas, and the volume of fluid provided to the fluid control unit is the total fluid collected over the different areas by the collection components.

Optionally, at least one collection component comprises one or more funnels, the one or more funnels being arranged to collect fluid over an area and to funnel the fluid into a smaller area.

According to a second aspect of the disclosure there is provided a method of monitoring the integrity of a subsea well or a fluid sequestration site, the method comprising capturing a volume of fluid being released by the subsea well or the fluid sequestration site, using a fluid control unit, directing the volume fluid to a detection unit, using the fluid control unit, and restricting the flow of the volume of fluid to the detection unit until its flow rate exceeds a threshold value, using the fluid control unit.

Optionally, the method comprises detecting a first predetermined chemical in the volume of fluid, using the detection unit.

It will be appreciated that the method of the second aspect may include features set out in the first aspect and can incorporate other features as described herein.

According to a third aspect of the disclosure there is provided an apparatus comprising a fluid control unit for restricting the flow of a volume of fluid until its flow rate exceeds a threshold value, the fluid control unit comprising a first unit enclosing a first volume and arranged to capture the volume of fluid within the first volume and to provide the volume of fluid to a second volume, and a second unit at least partially enclosing the first unit and enclosing the second volume and arranged to provide the volume of fluid from the second volume to a third volume, wherein the fluid control unit is configured to restrict the passage of the volume of fluid to the third volume until the flow rate of the volume of fluid exceeds a threshold value.

Optionally, the second volume is exterior to the first unit.

Optionally, the third volume is exterior to the first unit and the second unit.

Optionally, one or both of the first and second units are substantially cylindrical.

Optionally, the first unit comprises a first orifice arranged to permit the passage of the volume of fluid from an exterior of the first unit to the first volume, thereby capturing the volume of fluid within the first volume, and a second orifice arranged to permit the passage of the volume of the fluid from the first volume to the second volume, thereby redirecting the flow of the volume of fluid.

Optionally, the position of the second orifice on the first unit is adjustable.

Optionally, the first unit is configured to permit the adjustment of the position of the second orifice on the first unit.

Optionally, the first unit comprises a first inner cylinder and a first outer cylinder, the first inner cylinder being positioned at least partially within the first outer cylinder.

Optionally, an outer surface of the first inner cylinder is in physical contact with an inner surface of the first outer cylinder.

Optionally, the first inner cylinder comprises a first inner cylinder aperture, the first outer cylinder comprises a first outer cylinder aperture, wherein the apertures of the respective cylinders are arranged to partially overlap thereby forming the second orifice.

Optionally, the position at which the apertures of the first inner cylinder and the first outer cylinder partially overlap is adjustable, thereby permitting the adjustment of the position of the second orifice on the first unit.

Optionally, the first inner cylinder and/or the first outer cylinder is configured to be rotatable, wherein the position of the second orifice is controlled by the relative rotation of the first inner cylinder and the first outer cylinder.

Optionally, the first inner cylinder aperture is a slot and/or the first outer cylinder aperture is a slot.

Optionally, one of the first inner cylinder aperture and the first outer cylinder aperture is a vertical slot and the other of the first inner cylinder aperture and the first outer cylinder aperture is an angled slot.

Optionally, the second unit comprises a third orifice arranged to permit the passage of the volume of fluid from the second volume to the third volume, thereby redirecting the flow of the volume of fluid.

Optionally, the third orifice is at a greater depth than the second orifice when in use.

Optionally, the second unit comprises a fourth orifice arranged to permit the passage of the volume of fluid from the second volume to the third volume, thereby redirecting the flow of the volume of fluid, the third orifice being at a greater depth than the fourth orifice when in use.

Optionally, the position of the third orifice and/or fourth orifice on the second unit is adjustable.

Optionally, the second unit is configured to permit the adjustment of the position of the third orifice and/or fourth orifice on the second unit.

Optionally, the second unit comprises a second inner cylinder and a second outer cylinder, the second inner cylinder being positioned at least partially within the second outer cylinder.

Optionally, an outer surface of the second inner cylinder is in physical contact with an inner surface of the second outer cylinder.

Optionally, the second inner cylinder comprises a second inner cylinder aperture, the second outer cylinder comprises a second outer cylinder aperture, wherein the apertures of the respective cylinders are arranged to partially overlap thereby forming the third orifice and/or the fourth orifice.

Optionally, the position at which the apertures of the second inner cylinder and the second inner cylinder partially overlap is adjustable, thereby permitting the adjustment of the position of the third orifice and/or the fourth orifice on the second unit.

Optionally, the second inner cylinder and/or the second outer cylinder is configured to be rotatable, wherein the position of the third orifice and/or the fourth orifice is controlled by the relative rotation of the second inner cylinder and the second outer cylinder.

Optionally, the second inner cylinder aperture is a slot and/or the second outer cylinder aperture is a slot.

Optionally, one of the second inner cylinder aperture and the second outer cylinder aperture is a vertical slot and the other of the second inner cylinder aperture and the second outer cylinder aperture is an angled slot.

Optionally, the fluid control unit comprises a flow restriction component arranged to restrict the passage of the volume of fluid to the third volume until its flow rate exceeds the threshold value.

Optionally, the second unit comprises the flow restriction component.

Optionally, the flow restriction component comprises an aperture to provide a fluid passage from the second volume of the fluid control unit to an exterior of the fluid control unit, thereby permitting the passage of at least a portion of the volume of the fluid to the exterior of the fluid control unit.

Optionally, the flow restriction component comprises a conduit coupled to the aperture to provide the fluid passage from the second volume of the fluid control unit to the exterior of the fluid control unit, thereby permitting the passage of at least a portion of the volume of fluid to the exterior of the fluid control unit.

Optionally, the threshold value is dependent on the size of the aperture and/or a vertical position of the aperture when in use and/or the conduit.

Optionally, the size of the aperture and/or the vertical position of the aperture and/or the size of the conduit is adjustable.

Optionally, the third orifice is positioned at a greater depth than an outlet of the conduit when in use.

Optionally, the fluid control unit is configured to restrict the passage of the volume of fluid to the third volume via a first path until the flow rate of the volume of fluid exceeds a threshold value.

Optionally, the first path is provided by at least one of the third and fourth orifices.

Optionally, the fluid control unit is configured to provide the volume of fluid to the third volume via a second path if the quantity of a first predetermined chemical passing through at least a portion of the fluid control unit exceeds a threshold quantity.

Optionally, the fluid control unit comprises a fifth orifice, the fifth orifice providing the second path.

Optionally, the fifth orifice is closed by a plug comprising a first material that degrades in the presence of the first predetermined chemical.

Optionally, the plug is arranged to degrade to a sufficient degree to permit passage of the volume of fluid into the third volume via the fifth orifice when the quantity of the first predetermined chemical passing through and contacting the plug exceeds the threshold quantity.

Optionally, the second unit comprises the fifth orifice and the plug.

Optionally, the fifth orifice and the plug are in an upper surface of the second unit.

Optionally, the fluid control unit comprises a third unit at least partially enclosing the first unit and/or at least partially enclosing the second unit.

Optionally, the third unit is arranged to direct the flow of the volume of fluid upwards when in use.

Optionally, the third unit is arranged to direct the flow of the volume of fluid towards the third volume.

Optionally, the third unit encloses the third volume.

Optionally, the apparatus is configured to monitor the integrity of a subsea well or a fluid sequestration site.

Optionally, the apparatus comprises a detection unit configured to detect a first predetermined chemical within the third volume.

Optionally, the first predetermined chemical is a tracer fluid, or hydrogen, or carbon dioxide, or one or more hydrocarbons.

Optionally, the apparatus comprises a fluid collection unit configured to collect the volume of fluid, and provide the volume of fluid to the fluid control unit.

Optionally, the fluid collection unit is attachable to the subsea well.

Optionally, the fluid collection unit comprises two or more collection components arranged to collect fluid over different areas, and the volume of fluid provided to the fluid control unit is the total fluid collected over the different areas by the collection components.

Optionally, at least one collection component comprises one or more funnels, the one or more funnels being arranged to collect fluid over an area and to funnel the fluid into a smaller area.

It will be appreciated that the apparatus of the third aspect may include features set out in the first and second aspects and can incorporate other features as described herein.

According to a fourth aspect of the disclosure there is provided a method of restricting the flow of a volume of fluid until its flow rate exceeds a threshold value, the method comprising providing a first unit and a second unit, the second unit at least partially enclosing the first unit, capturing the volume of fluid within a first volume enclosed by the first unit providing the volume of fluid to a second volume enclosed by the second unit, providing the volume of fluid from the second volume to a third volume, and restricting the passage of the volume of fluid to the third volume until the flow rate of the volume of fluid exceeds a threshold value.

It will be appreciated that the method of the fourth aspect may include features set out in the third aspect and can incorporate other features as described herein.

BRIEF DESCRIPTION OF THE DRAWINGS

The disclosure is described in further detail below by way of example and with reference to the accompanying drawings in which:

FIG. 9(*b*) is a schematic of the apparatus of FIG. 8(*b*) in situ, with a large influx of hydrocarbons;

FIG. 15 is a table showing results from an analysis of apparatus as presented in FIGS. 9(*a*) and 9(*b*);

FIG. 18(*b*) is a schematic of a cross section of the inner cylinder,

FIG. 18(*c*) is a schematic of a cross section of the cylinders showing a relative rotational configuration providing the orifice at a first position, FIG. 18(*d*) is a schematic of a cross section of the cylinders showing a relative rotational configuration providing the orifice at a second position, FIG. 18(*e*) is a schematic of a cross section of the cylinders showing a relative rotational configuration providing the orifice at a third position, FIG. 18(*f*) is a schematic of a side profile view of the outer cylinder, FIG. 18(*g*) is a schematic of a side profile of the inner cylinder, FIG. 18(*h*) is a schematic of a side profile view of the cylinders showing a relative rotational configuration providing the orifice at the first position, FIG. 18(*i*) is a schematic of a side profile view of the cylinders showing a relative rotational configuration providing the orifice at the second position, FIG. 18(*j*) is a schematic of a side profile view of the cylinders showing a relative rotational configuration providing the orifice at the third position.

DETAILED DESCRIPTION

Figure 2C:
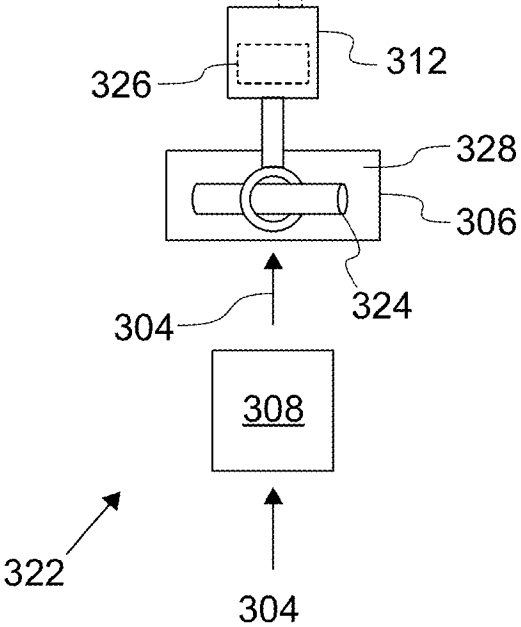
FIG. 2(*a*) is an apparatus for monitoring the integrity of a subsea well or a fluid sequestration site in accordance with a first embodiment of the present disclosure, FIG. 2(*b*) is an apparatus for monitoring the integrity of a subsea well or a fluid sequestration site in accordance with a second embodiment of the present disclosure, FIG. 2(*c*) is an apparatus for monitoring the integrity of a subsea well or a fluid sequestration site in accordance with a third embodiment of the present disclosure.
Figure 2B:
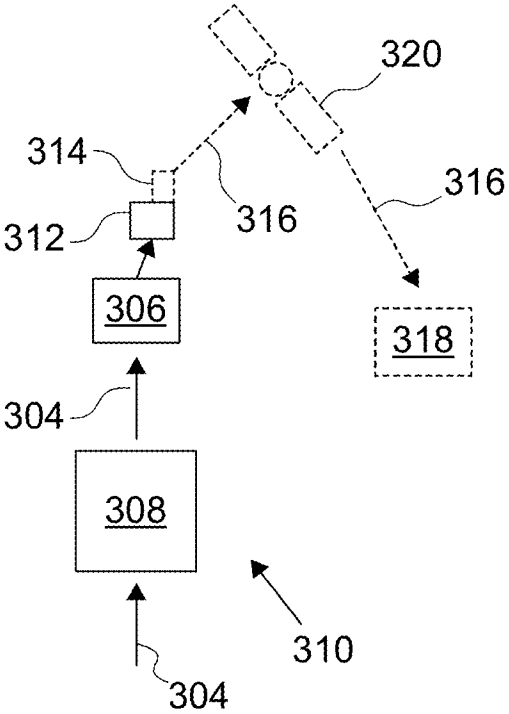
Figure 2A:
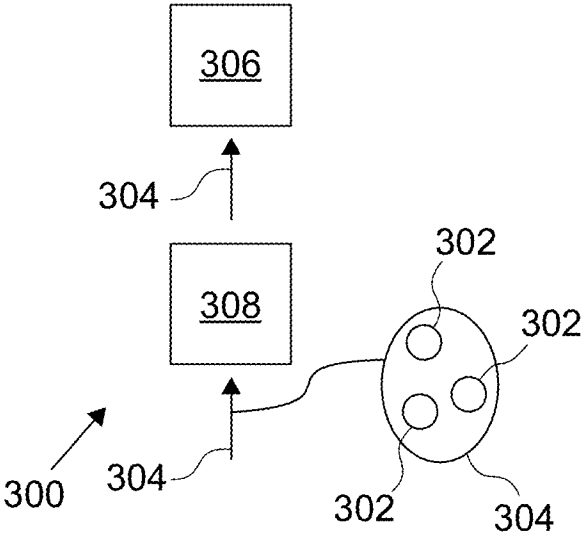

FIG. 2(*a*) is an apparatus 300 for monitoring the integrity of a subsea well or a fluid sequestration site in accordance with a first embodiment of the present disclosure. In operation the apparatus 300 detects the presence of a predetermined chemical 302 in a volume of fluid 304 only when the flow rate of the volume of fluid 304 exceeds a threshold value.

In FIG. 2(*a*) the volume of fluid 304 is denoted by an upward facing arrow. Also shown is a magnified inset of the volume of fluid 304 illustrating that it comprises the predetermined chemical 302. It will be appreciated that the volume of fluid 304 may comprise only the predetermined chemical 302 or may comprise the predetermined chemical 302 in addition to one or more additional components/chemicals.

The apparatus 300 comprises a detection unit 306 that is configured to detect the predetermined chemical 302. In a specific embodiment, the detection unit 306 may be configured to react to contact with the predetermined chemical 302, thereby detecting the predetermined chemical 302.

The apparatus 300 further comprises a fluid control unit 308 that is configured to capture the volume of fluid 304 and to direct the volume fluid 304 to the detection unit 306. The fluid control unit 308 is also configured to restrict the flow of the volume of fluid 304 to the detection unit 306 until the flow rate of the volume of fluid 304 exceeds the threshold value.

It will be appreciated that restriction of the flow of the volume of fluid 304 to the detection unit 306 can include stopping the flow to the detection unit 306 completely or only partially stopping the flow, such that a portion of the volume of fluid 304 still reaches the detection unit 306, until the threshold value is exceeded.

Figure 1C:
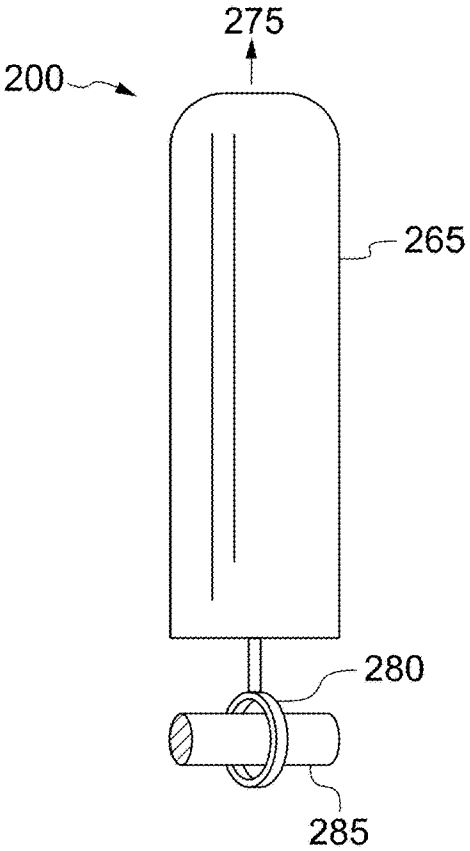
Figure 1c (Prior Art)
FIG. 1(*a*) is a schematic of a subsea hydrocarbon well apparatus as is known in the prior art, FIG. 1(*b*) is a schematic of a decommissioned well as is known in the prior art, FIG. 1(*c*) is a schematic of a beacon release mechanism.
Figure 1B:
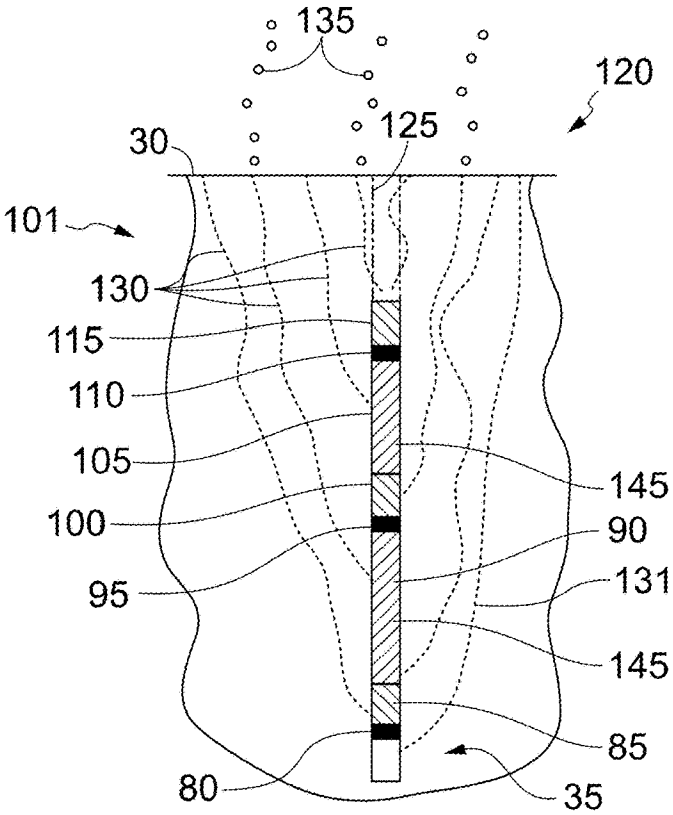
Figure 1b (Prior Art)
Figure 1A:
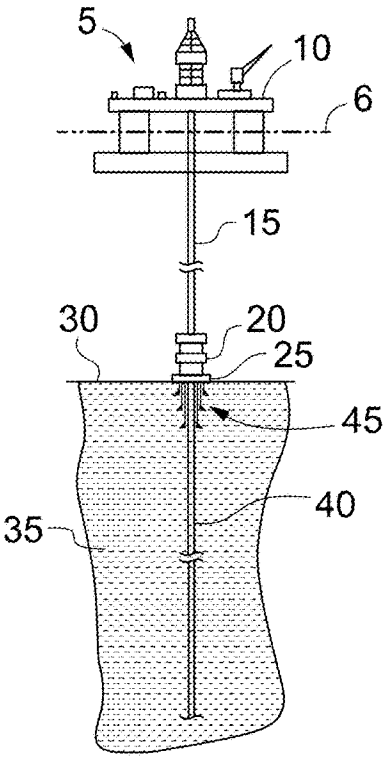
Figure 1a (Prior Art)

The predetermined chemical 302 may, for example, be a tracer fluid, as previously discussed in relation to FIGS. 1(*b*) and (c), or may be one or more hydrocarbons, or may be carbon dioxide or hydrogen. With reference to FIG. 1(*b*), in a specific embodiment, the predetermined chemical 302 may be the tracer fluid 145 having been mixed with one or more of the well kill fluids 90, 105 such that the detection of the tracer fluid 145 by the detection unit 306 is indicative of the well 101 having suffered a loss of integrity. The tracer fluid 145 may, for example, be the Sentinel Well Integrity Tracer (SWIFT) as discussed previously. The predetermined chemical 302 may, for example, be a liquid or a gas.

The fluid 304 and/or the predetermined chemical 302 may be less dense than water/sea water (or less dense than the sea water in the vicinity of the seabed where the monitoring apparatus is positioned), and therefore have a natural tendency to rise under their own inherent buoyancy.

As the fluid control unit 308 acts to restrict the flow of the volume of fluid 304 until the flow rate exceeds the threshold value, low-level/background emissions of fluid 304 including the chemical 302 will in effect be ignored by the apparatus 300. This is because the predetermined chemical 302 will not be received in sufficient quantity (or will not be received at all) by the detection unit 306 thereby avoiding unintended triggering of the detection unit 306. Once the flow rate exceeds the threshold value, as will be indicative of a failure in the integrity of the well 101, the detection unit 306 will receive a suitable quantity of the predetermined chemical 302 to be triggered and as a result will alert an operator to a well failure.

FIG. 2(*b*) is an apparatus 310 for monitoring the integrity of a subsea well or a fluid sequestration site in accordance with a second embodiment of the present disclosure. The apparatus 310 comprises a signalling device 312 that is used to signal when the predetermined chemical 302 is detected. This is achieved by the detection unit 306 activating the signalling device 312 in response to the detection of the predetermined chemical 302.

The signalling device 312 may comprise at least one beacon 314 configured to transmit a signal 316 to alert an operator 318 to a loss of integrity in the subsea well or fluid sequestration site upon activation of the signalling device 312. The signal 316 may be transmitted to the operator 318 via a satellite 320.

FIG. 2(*c*) is an apparatus 322 for monitoring the integrity of a subsea well or a fluid sequestration site in accordance with a third embodiment of the present disclosure. The detection unit 306 comprises a material 324 that is configured to react to contact with the predetermined chemical 302 by degrading in response to contact with the predetermined chemical 302.

The detection unit 306 may be configured to activate the signalling device 312 in response to the degradation of the material 324, for example by having the loss of structural integrity of the material 324 initiate the release of the signalling device 312. The signalling device 312 may comprise a buoyant component 326 such that the signalling device 312 rises to the water surface upon its release.

The detection unit 306 may comprise a secondary fluid 328 configured to protect the material 324 from degradation prior to use.

It will be appreciated that the detection unit 306 as described in relation to FIG. 2(*c*) may be implemented as part of the detection unit 306 of the apparatuses 300, 310 of FIGS. 2(*a*) and 2(*b*), respectively, or of any other apparatus as described herein and in accordance with the understanding of the skilled person.

Furthermore, the material 324 may comprise the trigger rod 285 as discussed previously, such that the detection unit 306 functions as described in relation to FIG. 1(*c*). It will be appreciated that other detection unit 306 configurations are possible, in accordance with the understanding of the skilled person.

Figure 3B:
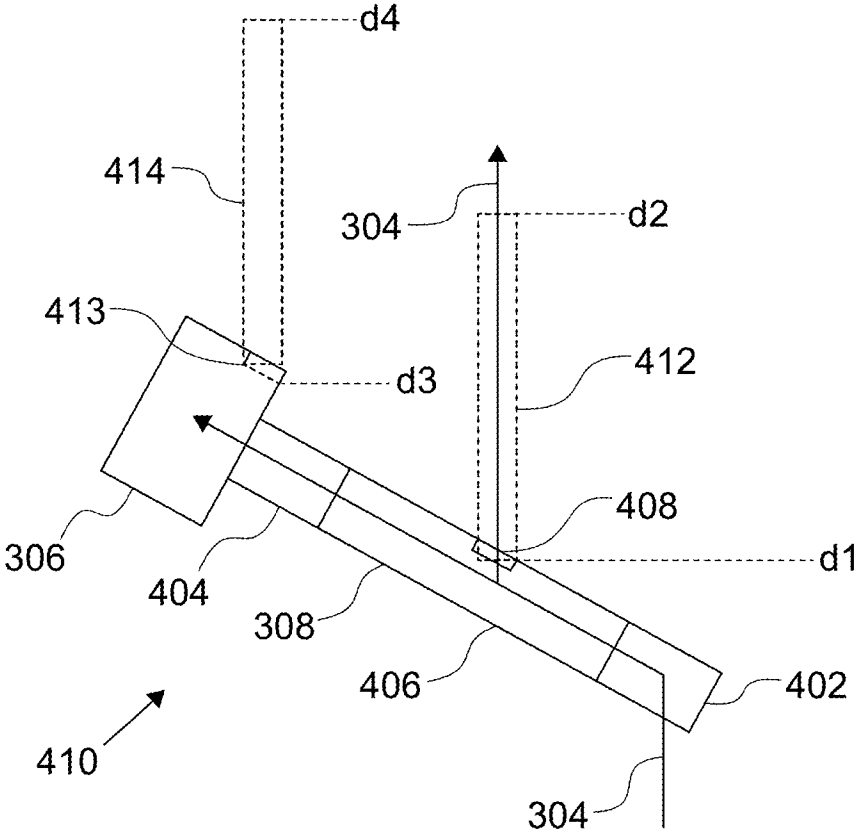
FIG. 3(*a*) is a schematic of an apparatus in accordance with a fourth embodiment of the present disclosure, FIG. 3(*b*) is a schematic of an apparatus in accordance with a fifth embodiment of the present disclosure.
Figure 3A:
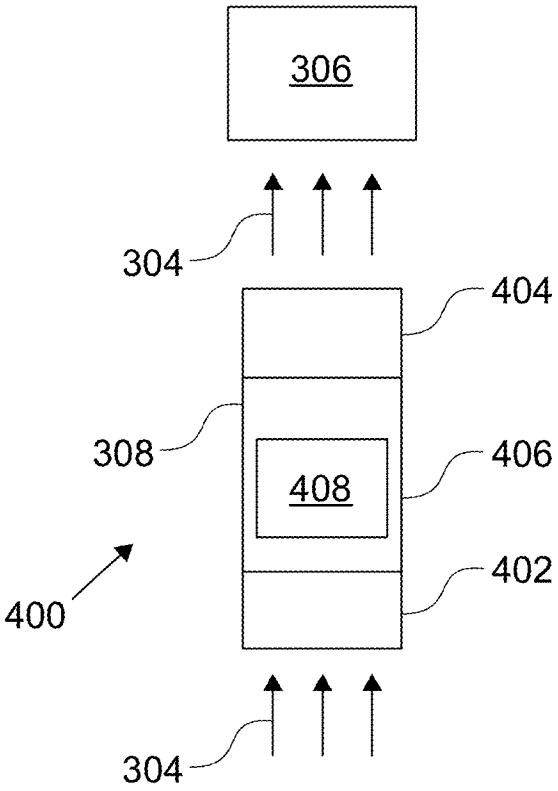

FIG. 3(*a*) is a schematic of an apparatus 400 in accordance with a fourth embodiment of the present disclosure. The apparatus 400 comprises a specific implementation of the fluid control unit 308 that may be implemented in any of the apparatuses as described herein, in accordance with the understanding of the skilled person.

The fluid control unit 308 comprises an input portion 402 that is arranged to capture the volume of fluid 304. The fluid control unit 308 further comprises an output portion 404 that is arranged to provide the volume of fluid 304 to the detection unit 306. The fluid control unit 308 further comprises a fluid path portion 406 that is positioned between the input portion 402 and the output portion 404.

The fluid path portion 406 is arranged to direct the volume of fluid 304 from the input portion 402 to the output portion 404.

It will be appreciated that in further embodiments there may be one or more intermediate portions positioned between the input portion 402 and the fluid path portion 406, and/or between the fluid path portion 406 and the output portion 404.

The fluid path portion 406 may comprise a flow restriction component 408 to restrict the flow of the volume of fluid 304 to the detection unit 306 until the flow rate of the volume of fluid 304 exceeds the threshold value.

FIG. 3(*b*) is a schematic of an apparatus 410 in accordance with a fifth embodiment of the present disclosure. The apparatus 410 illustrates a specific implementation of the flow restriction component 408. In the present example, the flow restriction component 408 comprises an aperture 408. The aperture 408 provides a fluid passage from an interior of the fluid control unit 308 to an exterior of the fluid control unit 308. The inclusion of the aperture 408 permits passage of at least a portion of the volume of the fluid 304 from the interior of the fluid control unit 308 to the exterior of the fluid control unit 308. It will be appreciated that in further embodiments the flow restriction component may comprise more than one aperture.

The orientation of the apparatus 410 of the present embodiment is chosen to take advantage of the buoyancy of the volume of fluid 304 and the predetermined chemical 302, that means that they travel upward by their own buoyancy. Furthermore, in the present example, the aperture 408 is positioned in an upward facing surface of the fluid control unit 308 when the apparatus 410 is deployed in a subsea environment and it is in use. It will be appreciated that other configurations and orientations are possible, in accordance with the understanding of the skilled person.

The threshold value of flow rate above which the passage of the volume of fluid 304 is permitted is dependent on the size of the aperture 408 in the present example. The size of the aperture 408 may be adjustable to enable a user to control the threshold value of the flow rate. The threshold value may be set prior to the deployment of the apparatus 410 in the vicinity of a subsea well or sequestration site. Alternatively, or additionally, the size of the aperture 408 may be adjustable after deployment of the apparatus 410.

The threshold value of the flow rate above which the passage of the volume of fluid 304 is permitted may also be dependent on the vertical position of the aperture 408 when the apparatus 410 is in use. The vertical position of the aperture 408 may be adjustable.

The apparatus 410 may comprise a conduit 412 coupled to the aperture 408 and providing a fluid passage from the interior of the fluid control unit 306 to its exterior. The depth of the two ends of the conduit 412 are denoted by d1 and d2, respectively.

The detection unit 306 may comprise one or more vents 413 to permit the passage of fluids from the interior of the detection unit 306 to its exterior. The apparatus 410 may comprise a second conduit 414 that is coupled to one of the vents 413. The depth of the two ends of the conduit 414 are denoted by d3 and d4, respectively.

Figures 4A, 4B, 4C:
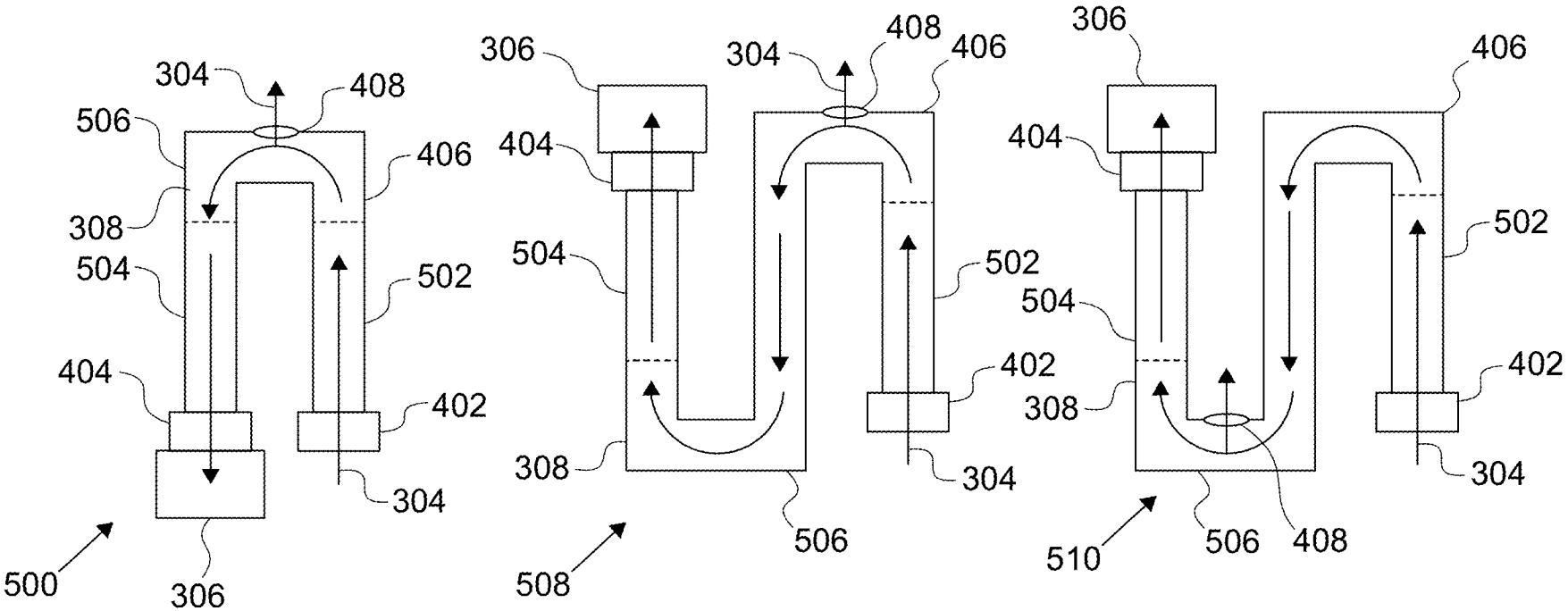
FIG. 4(*a*) is a schematic of an apparatus in accordance with a sixth embodiment of the present disclosure, FIG. 4(*b*) is a schematic of an apparatus in accordance with a seventh embodiment of the present disclosure, FIG. 4(*c*) is a schematic of an apparatus in accordance with an eighth embodiment of the present disclosure, FIG. 4(*d*) is a schematic of an apparatus in accordance with a ninth embodiment of the present disclosure, FIG. 4(*e*) is a schematic of an apparatus in accordance with a tenth embodiment of the present disclosure.
Figure 4E:
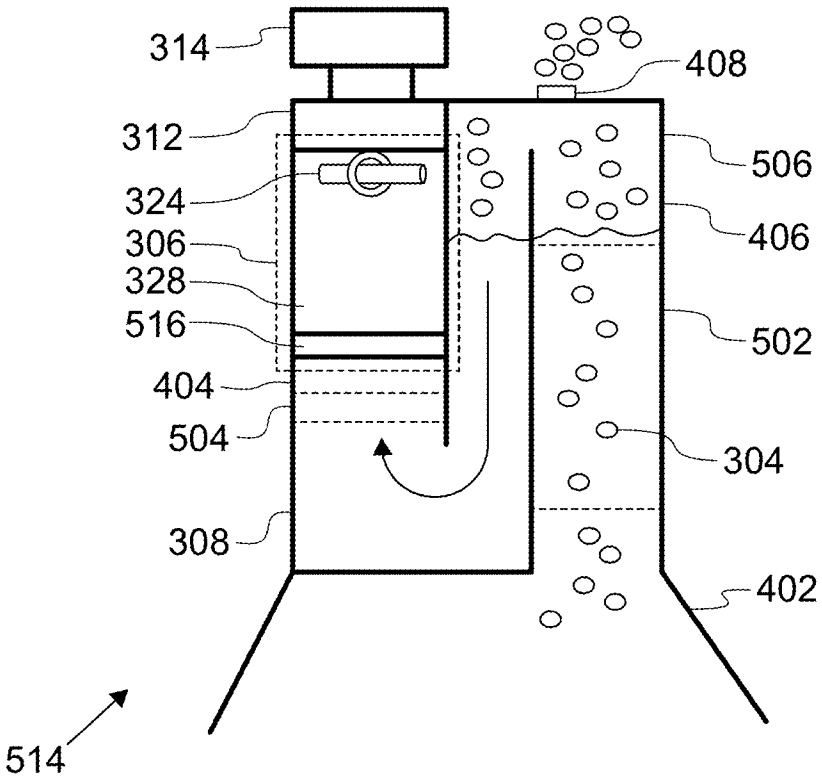
Figure 4D:
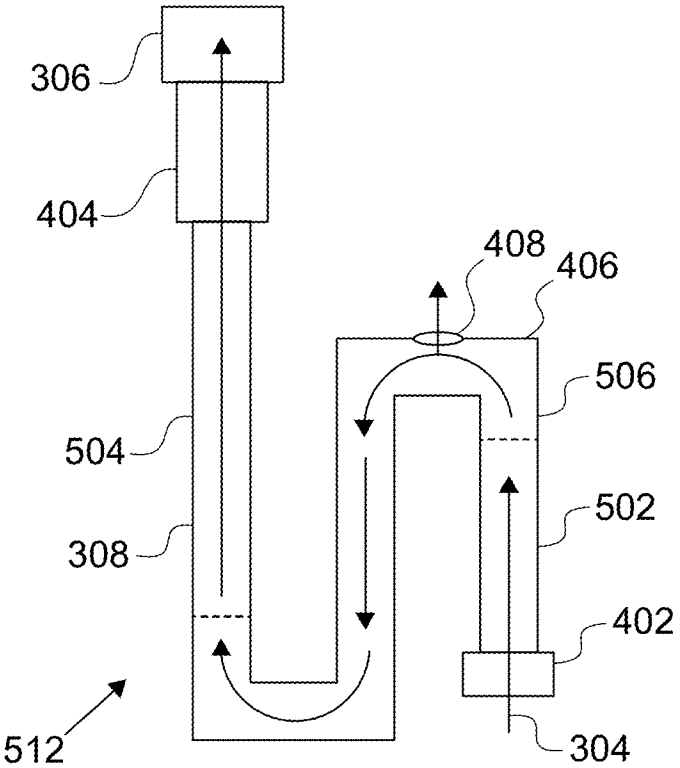

FIG. 4(*a*) is a schematic of an apparatus 500 in accordance with a sixth embodiment of the present disclosure. The apparatus 500 illustrates a specific implementation of the fluid path portion 406.

The fluid path portion 406 comprises a first portion 502, a second portion 504 and a flow redirect portion 506. The fluid path portion 406 is arranged to provide a main fluid path (as illustrated by the passage of the volume of fluid 304) from the input portion 402 to the first portion 502, from the first portion 502 to the flow redirect portion 506, from the flow redirect portion 506 to the second portion 504, and from the second portion 504 to the output portion 404. The flow redirect portion 506 is arranged to redirect the main fluid path. For example, in the present embodiment, the flow redirect portion 506 received the volume of fluid 304 as it travels in an upward direction when in use. The flow is then redirected such that the flow is directed downwards. Further embodiment, may include the flow being directed in different ways, as is presented in further embodiments described herein.

FIG. 4(*b*) is a schematic of an apparatus 508 in accordance with a seventh embodiment of the present disclosure. FIG. 4(*c*) is a schematic of an apparatus 510 in accordance with an eighth embodiment of the present disclosure. FIG. 4(*d*) is a schematic of an apparatus 512 in accordance with a ninth embodiment of the present disclosure.

The apparatuses 508, 510, 512 illustrate a specific implementation of the fluid path portion 406 where, the fluid path portion 406 comprises an s-bend comprising the first portion 502, the second portion 504 and the flow redirect portion.

It will be appreciated that in further embodiments, rather than an s-bend, alternative configurations may be used such as a u-bend.

For each of the apparatuses 500, 508, 510, 512 the fluid path portion 506 comprises the flow restriction component 408 which is arranged to restrict the flow of the volume of fluid 304 to the detection unit 306 until its flow rate exceeds the threshold value. The flow restriction component 408 may, for example, be the aperture 408 as described previously in relation to FIG. 3(*b*).

The flow redirect portion 506, as presented in the previous embodiments and further embodiments below, may act to redirect the flow of the volume of fluid 304 as a result of its geometry and the pressure provided by the volume of fluid 304.

FIG. 4(*e*) is a schematic of an apparatus 514 in accordance with a tenth embodiment of the present disclosure. The apparatus 514 comprises features as described previously in relation to FIGS. 4(*a*)-(*d*), The s-bend 406 comprises a flapper valve 516. The flapper valve 516, when closed, acts to form an enclosed volume for the local environment of the trigger material 324. Within this enclosed volume is the secondary fluid 328 which is an inert fluid that is used to protect the material 324 from degradation prior to use. In the present example, the material 324 is illustrated as comprising a trigger rod as discussed previously. However, it will be appreciated that other implementations of the trigger material 324 may be used in further embodiments in accordance with the understanding of the skilled person.

In the present example, the pre-determined chemical 302 to be detected is a hydrocarbon. It will be appreciated that in further embodiments the pre-determined chemical may be carbon dioxide or hydrogen. In operation, and after deployment of the apparatus 514, the flapper valve 516 is opened to expose the trigger material 324 to the subsea environment. On a suitably large influx of the volume of fluid 304 comprising hydrocarbons, the hydrocarbons 302 will fill the chamber, displace the secondary fluid 328 and begin to degrade the trigger material 324. The secondary fluid 328 may be lighter than water and/or heavier than hydrocarbons.

The aperture 408 functions as a regulator valve to disperse a small influx of the volume of fluid 304 and therefore provide the threshold value below which the predetermined chemical 302 will not reach the trigger material 324 in a sufficient quantity to degrade the material 324.

Figure 5B:
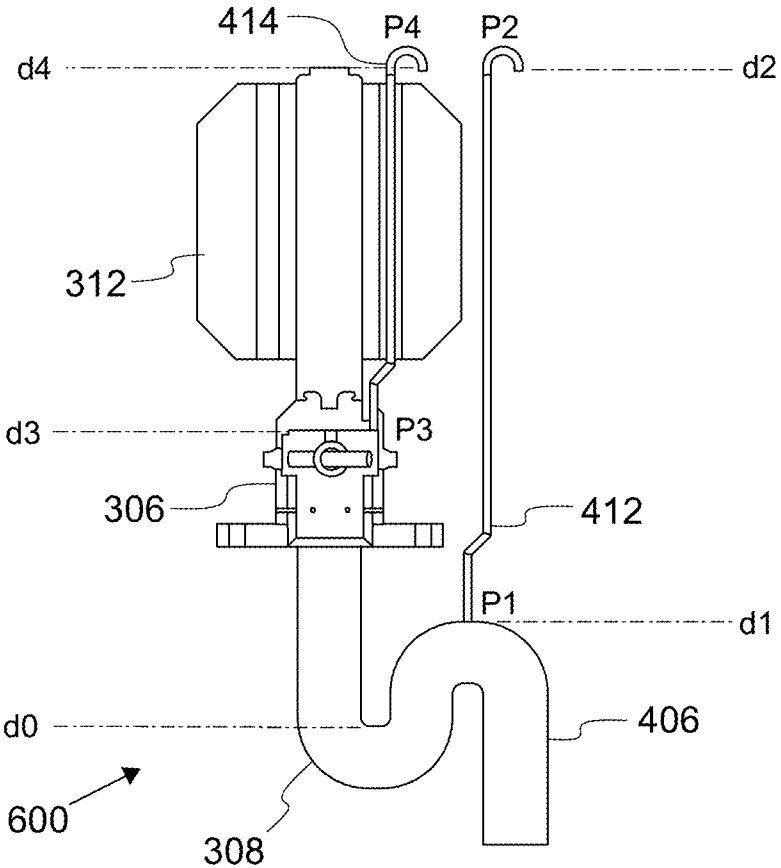
FIG. 5(*a*) is a schematic of an apparatus in accordance with an eleventh embodiment of the present disclosure, FIG. 5(*b*) is an alternative schematic of the apparatus of FIG. 5(*a*) with depths and pressure labelled.
Figure 5A:
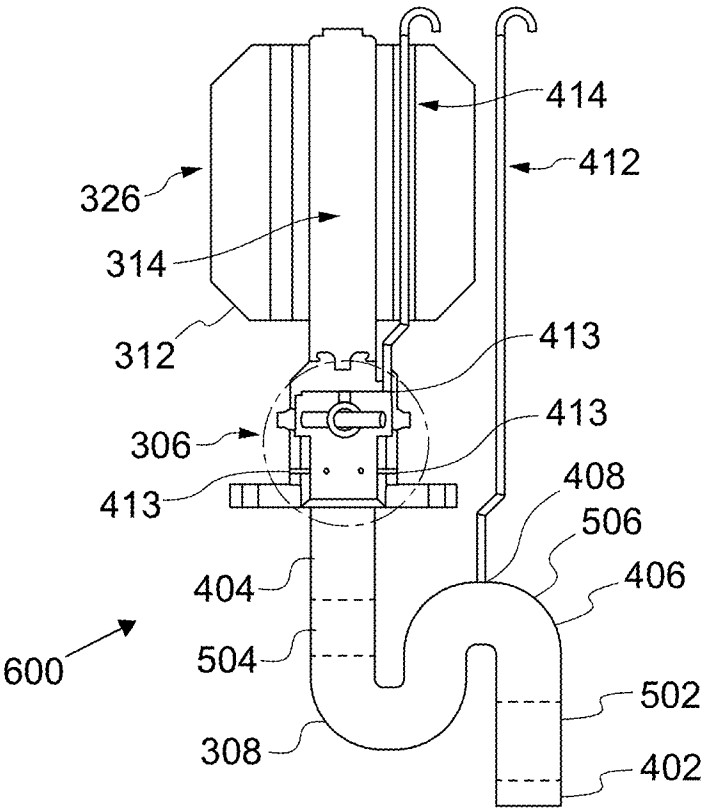
Figure 6B:
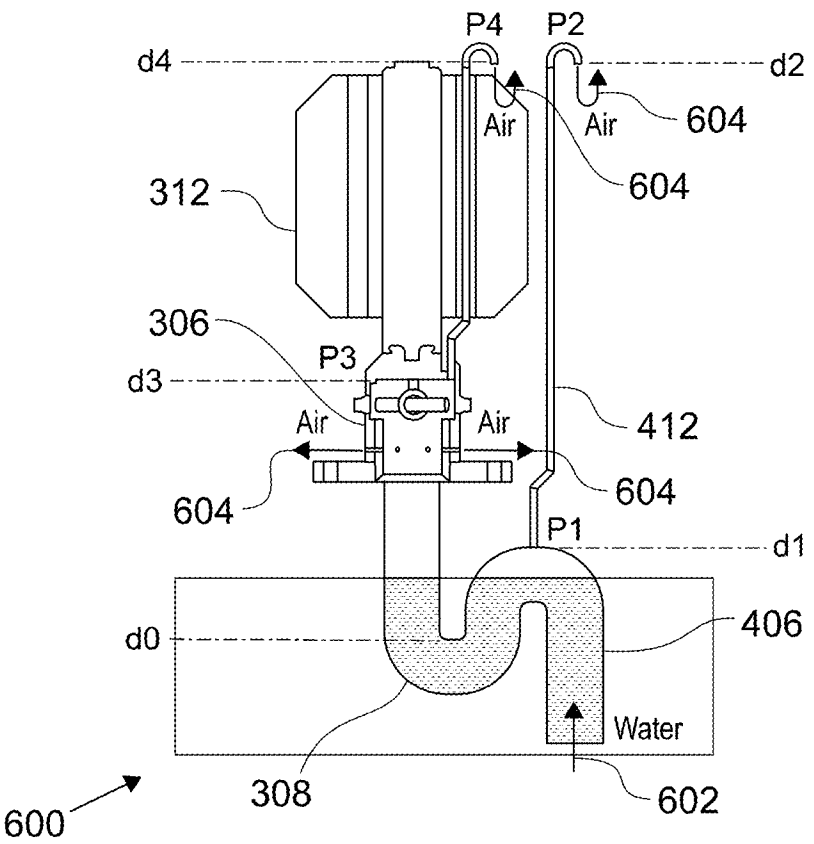
FIG. 6(*a*) is a further schematic of the apparatus of FIG. 5(*a*) illustrating a first step of its deployment, FIG. 6(*b*) is a schematic of the apparatus of FIG. 5(*a*) illustrating a second step of its deployment, FIG. 6(*c*) is a schematic of the apparatus of FIG. 5(*a*) illustrating a third step of its deployment, FIG. 6(*d*) is a schematic of the apparatus of FIG. 5(*a*) illustrating a fourth step of its deployment, FIG. 6(*e*) is a schematic of the apparatus of FIG. 5(*a*) illustrating a fifth step of its deployment, FIG. 6(*f*) is a schematic of the apparatus of FIG. 5(*a*) after having been deployed and being operable.
Figure 6A:
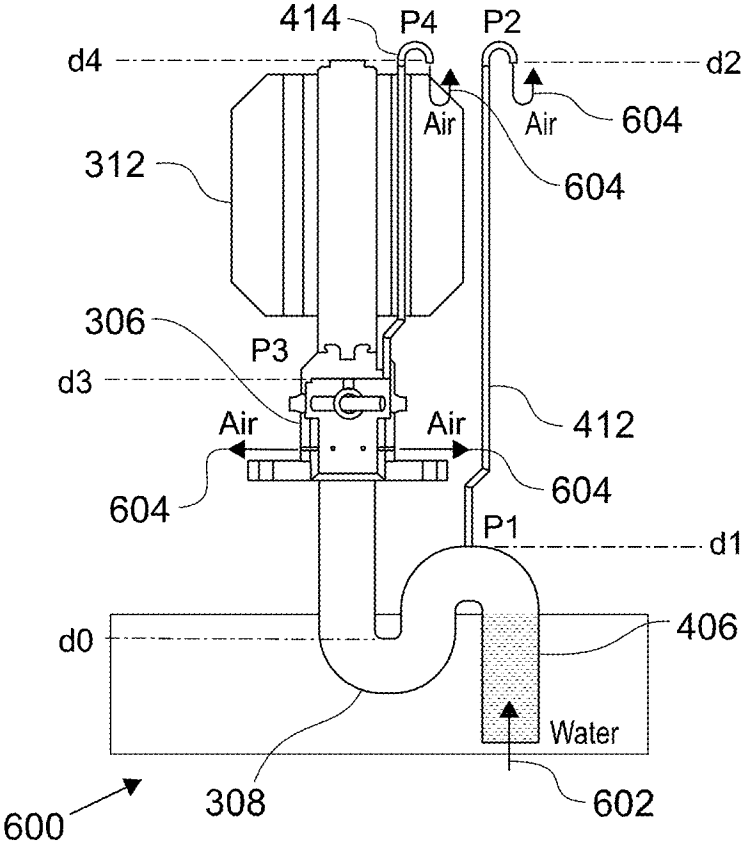
Figure 6D:
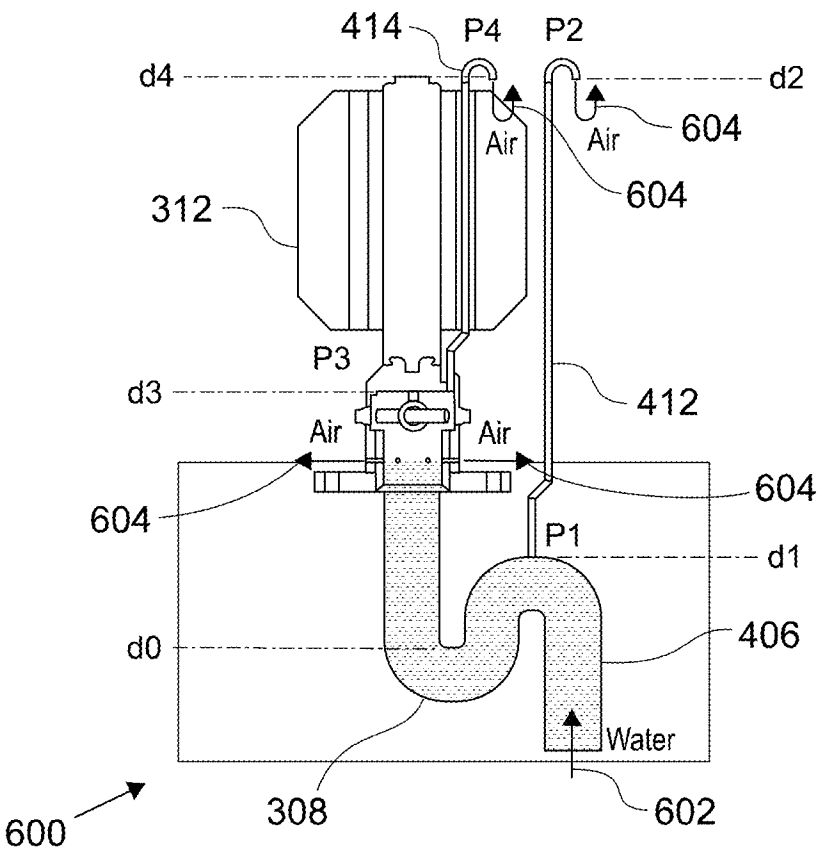
Figure 6C:
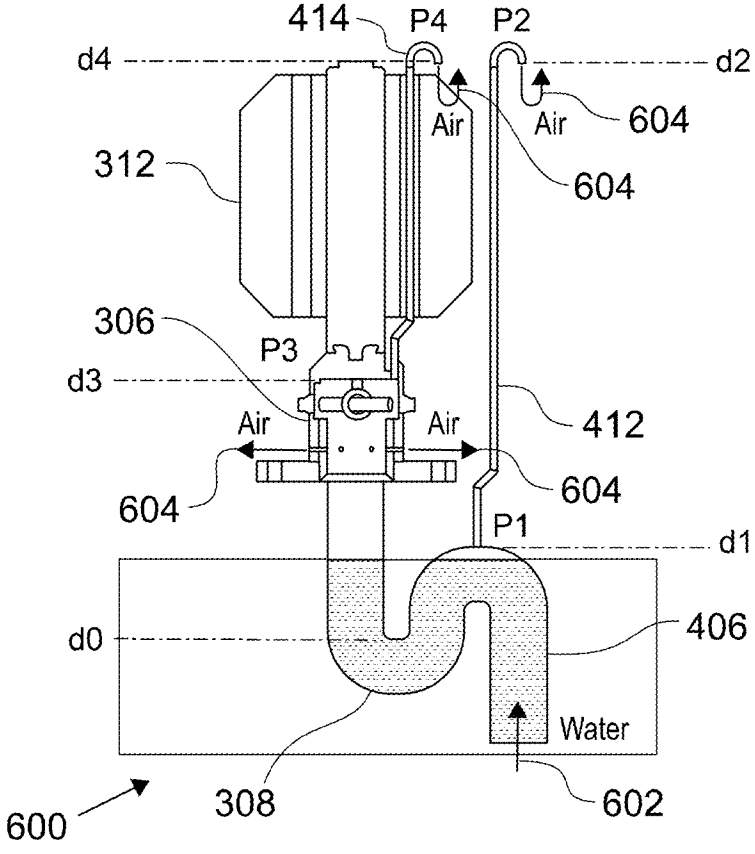
Figure 6F:
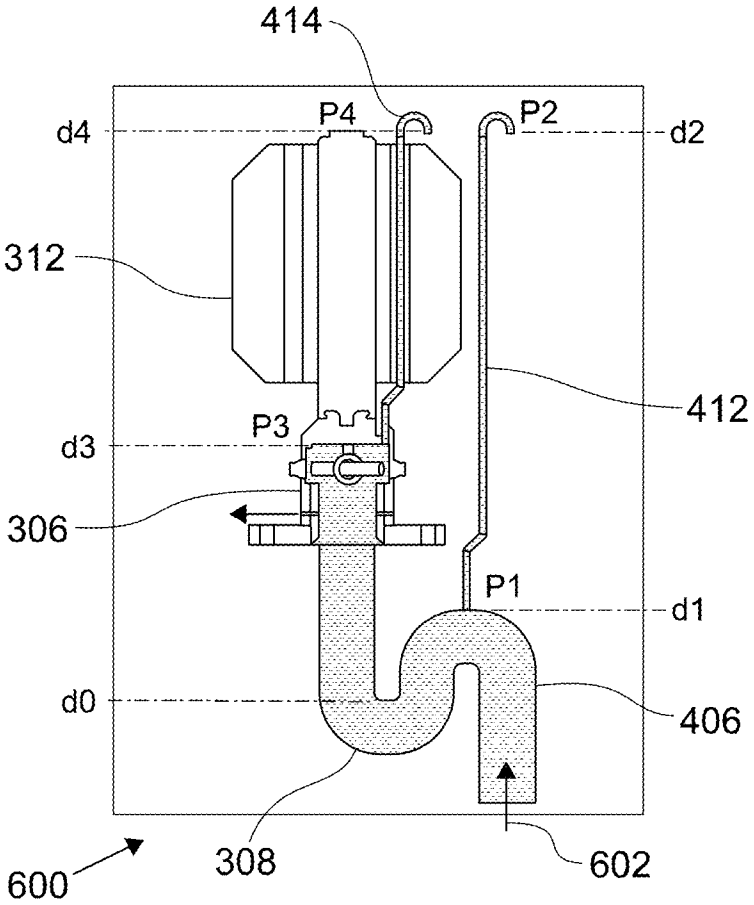
Figure 6E:
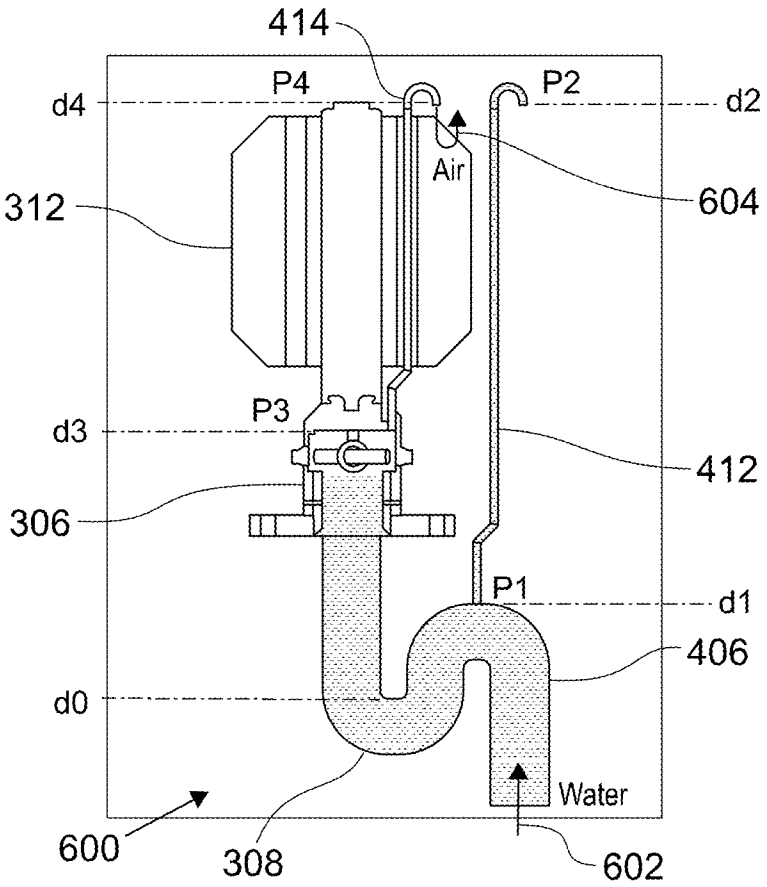

FIG. 5(*a*) is a schematic of an apparatus 600 in accordance with an eleventh embodiment of the present disclosure. The schematic illustrated in FIG. 5(*a*) illustrates the apparatus 600 in-situ with the fluid control unit 308 functioning as a fluid diverter and being positioned under the monitoring module assembly provided by the detection unit 306 and the signalling device 312. It can be seen that the main exhaust of the s-bend 406, provided by the output portion 404, feeds into the bottom of the reaction chamber housing, provided by the detection unit 306. In the present example, the material 324 (not labelled to aid in the clarity of the drawing) is illustrated as comprising a trigger rod as discussed previously. However, it will be appreciated that other implementations of the trigger material 324 may be used in further embodiments in accordance with the understanding of the skilled person.

FIG. 5(*b*) is an alternative schematic of the apparatus 600 with depths and pressure labelled. Specific reference numerals present in FIG. 5(*a*) have been omitted in FIG. 5(*b*) and in subsequent Figures to aid in the clarity of the drawings. P1 denotes the pressure at depth d1; P2 denotes the pressure at depth d2; P3 denotes the pressure at depth d3; and P4 denotes the pressure at depth d4. Also shown is a depth d0 which is at a greater depth than depths d1, d2, d3, d4. It will be appreciated that the drawings are not to scale.

FIG. 6(*a*) is a further schematic of the apparatus 600 illustrating a first step of its deployment, where water 602 enters the bottom of the s-bend 406, resulting in the displacement of air 604. FIG. 6(*b*) is a schematic of the apparatus 600 illustrating a second step of its deployment as the water 602 continues to fill the s-bend 406. FIGS. 6(*c*), 6(*d*) and 6(*e*) are schematics of the apparatus 600 illustrating third, fourth and fifth steps of its deployment, respectively. FIG. 6(*f*) is a schematic of the apparatus 600 after having been deployed and being operable. The vents 413 are now able to allow higher density fluids to escape from the reaction chamber 306 when necessary, e.g. water 602 displaced by lighter hydrocarbons.

Figure 7B:
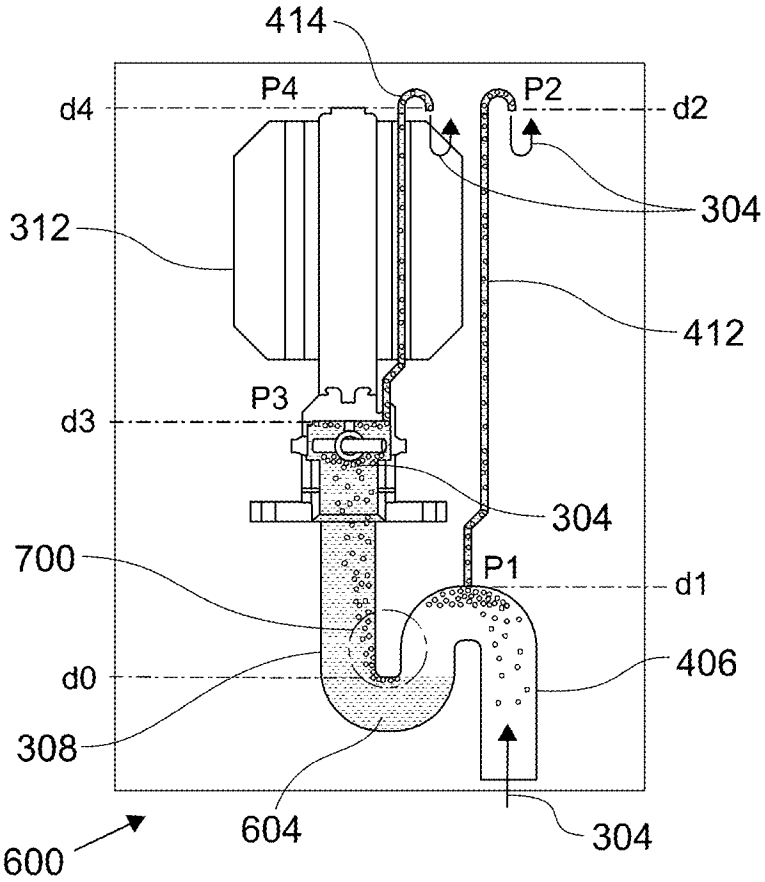
FIG. 7(*a*) is a schematic of the apparatus of FIG. 5(*a*) in use where the flow rate is below the threshold value, FIG. 7(*b*) is a schematic of the apparatus of FIG. 5(*a*) in use when the flow rate is above the threshold value.
Figure 7A:
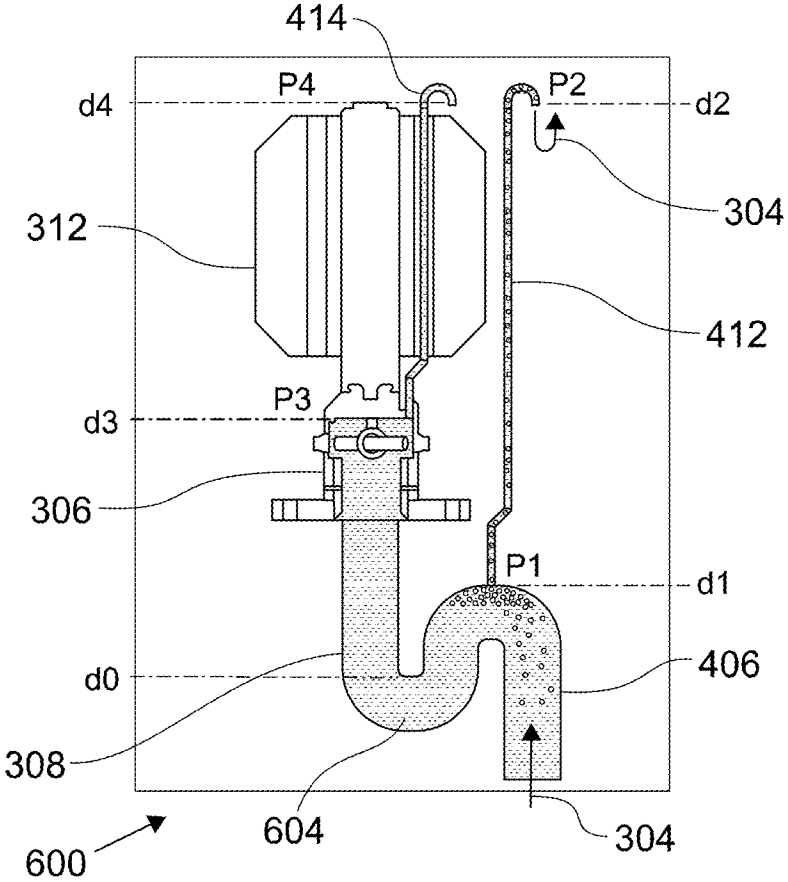

FIG. 7(*a*) is a schematic of the apparatus 600 in use where the flow rate of the volume of fluid 304 is below the threshold value as set by the aperture 408. In the present example the predetermined chemicals 302 to be detected are one or more hydrocarbons. The hydrocarbons are lighter than the surrounding material. This means that the small influx of hydrocarbons first gathers in the top of the first bend of the s-bend 406, and the pressure differential between P1 and P2 helps drive the more buoyant fluid out of the top of the conduit 412.

FIG. 7(*b*) is a schematic of the apparatus 600 in use where the flow rate of the volume of fluid 304 is above the threshold value as set by the aperture 408. In the present example, the large influx of hydrocarbons does not exit the conduit 412 quickly enough to match the inflow and will therefore displace water towards the lower bend of the s-bend 406. Once the volume of fluid 304 reaches the depth DO, the buoyant fluid 304 will start to rise into the reaction chamber 306 and vent from the conduit 414 at pressure P4.

As the flow rate of the volume of fluid 304 is of a sufficient value to exceed the threshold value, the predetermined chemical 302 will contact the trigger material 324 (not labelled) which will degrade, as discussed previously. It will be appreciated that in further embodiments, other detection mechanisms may be provided by the detection unit 306, in accordance with the understanding of the skilled person.

A section of the s-bend 406 has been highlighted (labelled 700), indicating a region of s-bend that may limit the flow of excess hydrocarbons into the reaction chamber 306 and which may be difficult to tune to different flow requirements due to its geometry. Although highlighted in FIG. 7(*b*) other systems discussed herein may also be subject to this characteristic.

Figure 8B:
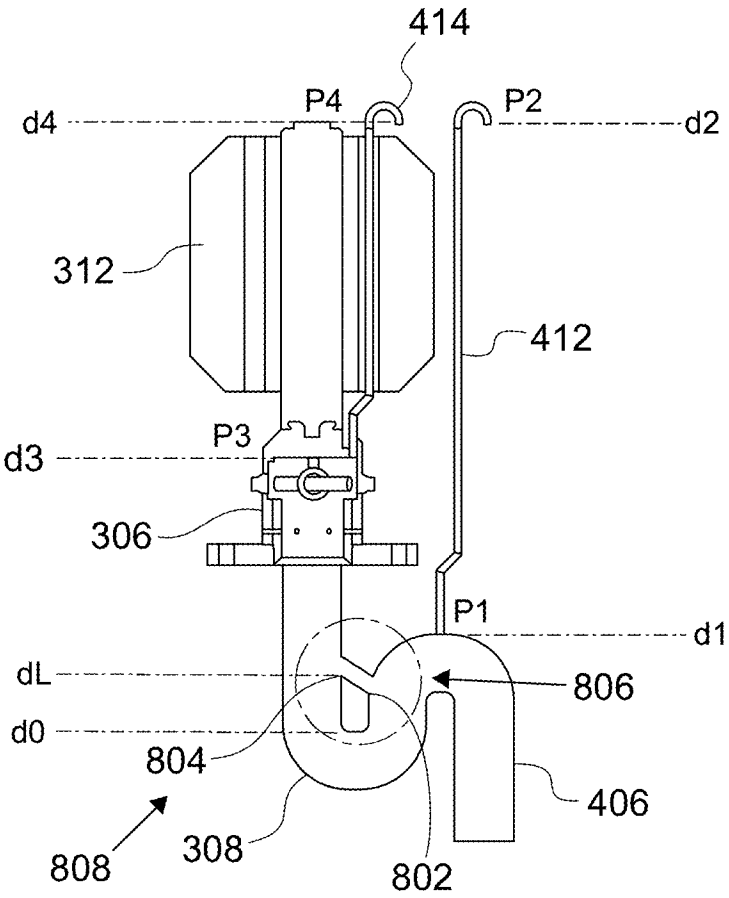
FIG. 8(*a*) is a schematic of an apparatus in accordance with a twelfth embodiment of the present disclosure, FIG. 8(*b*) is a schematic of an apparatus in accordance with a thirteenth embodiment of the present disclosure.
Figure 8A:
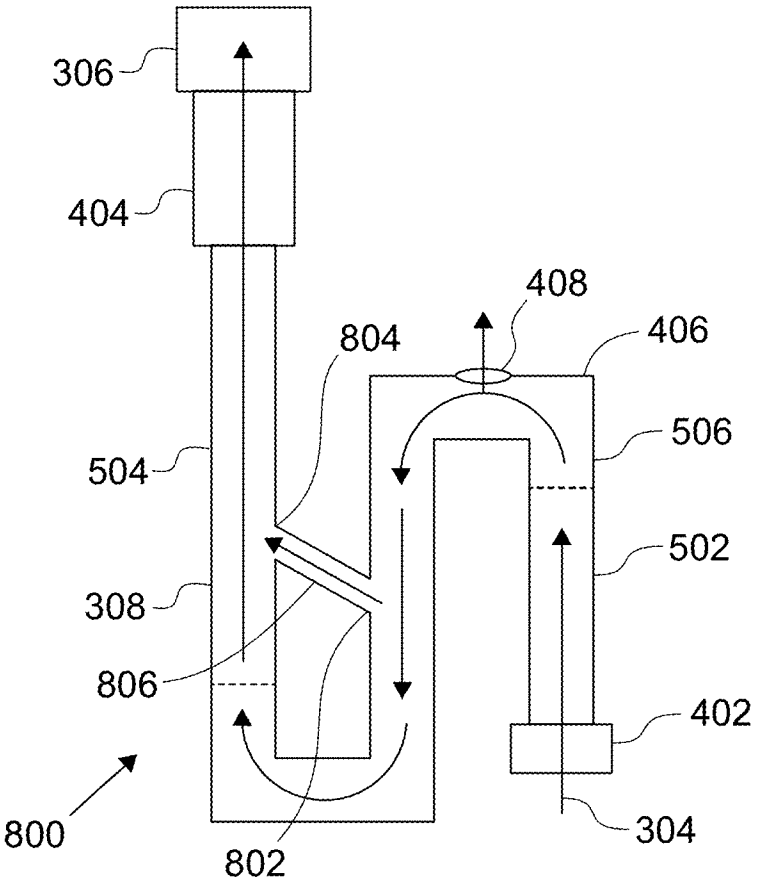

FIG. 8(*a*) is a schematic of an apparatus 800 in accordance with a twelfth embodiment of the present disclosure. The apparatus 800 is an alternative embodiment of the apparatus 512 where the flow redirect portion 506 and the second portion 504 each comprise orifices 802, 804 which are coupled to provide an additional fluid path between the two portions. It can be observed that the additional fluid path is above the main fluid path and the fluid control unit comprises an additional flow conduit 806 coupled to the two orifices 802, 804. It will be appreciated that this configuration providing an additional fluid path may be applied to any of the other apparatuses as disclosed herein in accordance with the understanding of the skilled person. When applied to the apparatus 514 or a similar apparatus, it will be appreciated that the additional flow conduit 806 is unnecessary and only a single orifice 802 is required. When in use the orifice 802 is positioned below the orifice 804 such that the buoyancy of the volume of fluid 304 contributes to the operation of the additional fluid path. This arrangement provides improved tuning of the flow requirements, including the threshold value of flow rate, as described in relation to FIG. 7(*b*) and the labelled section 700.

FIG. 8(*b*) is a schematic of an apparatus 808 in accordance with a thirteenth embodiment of the present disclosure. The apparatus 808 is an alternative embodiment of the apparatus 600 comprising the orifices 802, 804 and the additional flow conduit 806 which function as described previously in relation to FIG. 8(*a*). Also shown is a depth dL.

The additional flow conduit 806 is a smaller path for the excess fluid to follow. The additional fluid path becomes the dominant flow path over the main fluid path which follows the lower portion of the s-bend 406, due to the buoyancy of the volume of fluid 304 compared to the surrounding water.

Figure 9B:
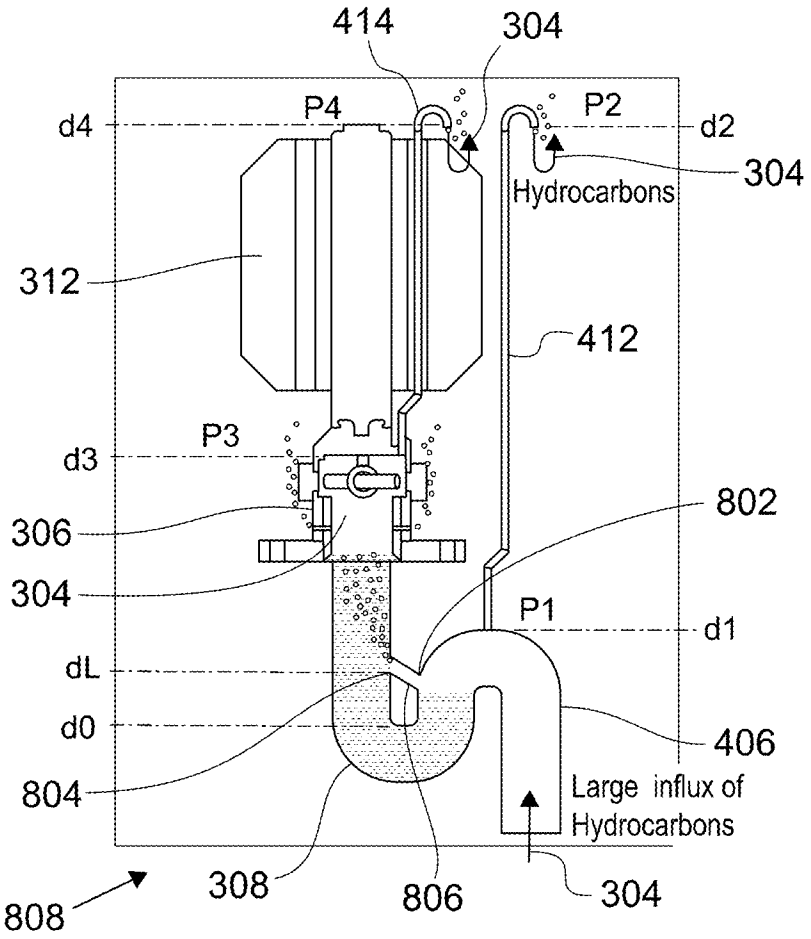
FIG. 9(*a*) is a schematic of the apparatus of FIG. 8(*b*) in situ.
Figure 9A:
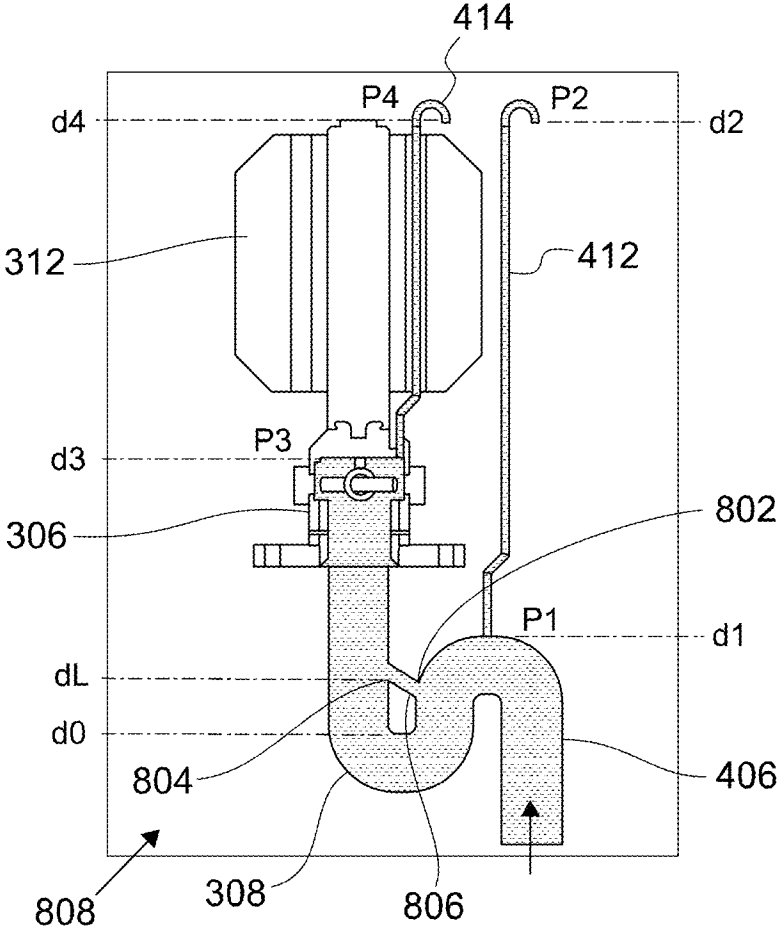
Figure 10B:
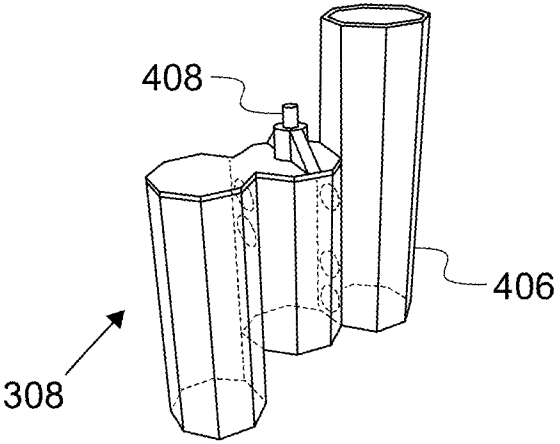
FIG. 10(*a*) is a schematic of a specific implementation of the fluid control unit in accordance with a fourteenth embodiment of the present disclosure, FIG. 10(*b*) is a schematic of an X-ray view of the specific implementation of the fluid control unit, FIG. 10(*c*) is a schematic showing a sectional view of the specific implementation of the fluid control unit, FIG. 10(*d*) is a photograph of a 3D printed part of the specific implementation of the fluid control unit.
Figure 10D:
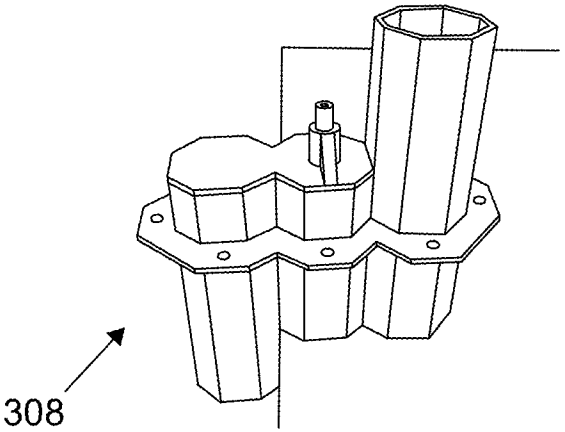
Figure 10A:
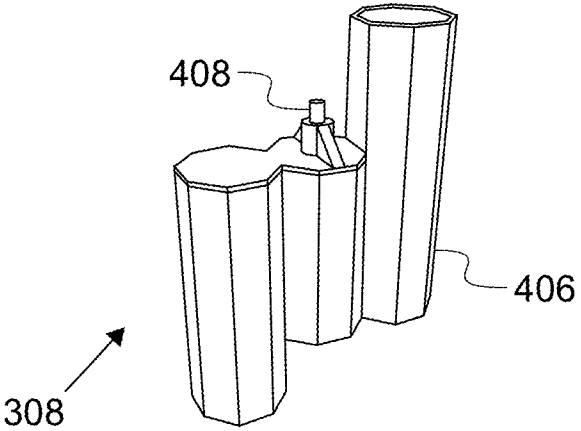
Figure 10C:
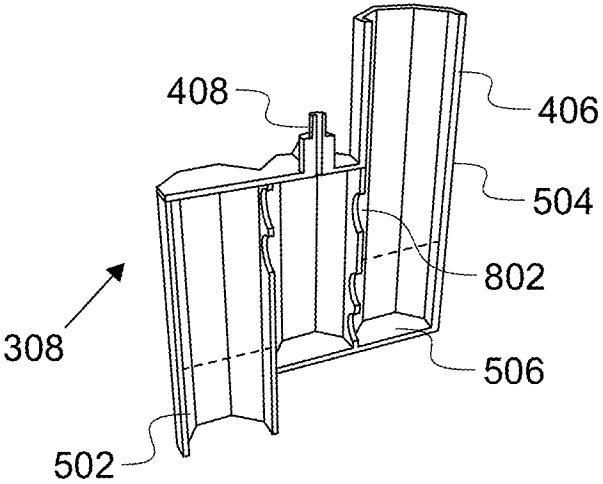
Figure 11C:
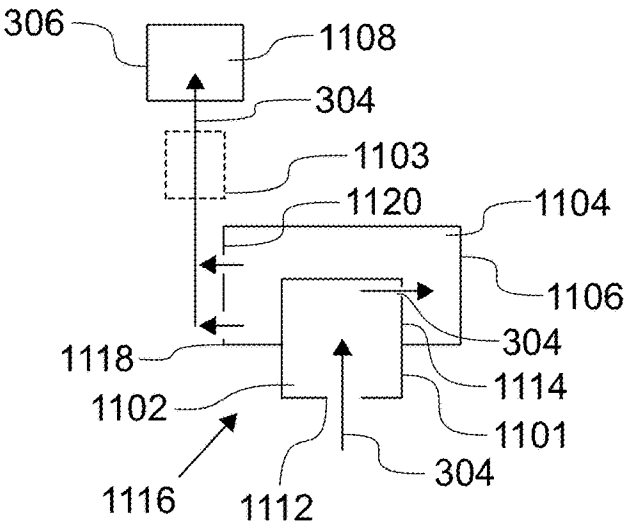
FIG. 11(*a*) is a schematic of a fluid control unit which is a specific implementation of the fluid control unit in accordance with a fifteenth embodiment of the present disclosure, FIG. 11(*b*) is a schematic of a fluid control unit which is a specific implementation of the fluid control unit in accordance with a sixteenth embodiment of the present disclosure, FIG. 11(*c*) is a schematic of a fluid control unit which is a specific implementation of the fluid control unit in accordance with a seventeenth embodiment of the present disclosure, FIG. 11(*d*) is a schematic of a fluid control unit which is a specific implementation of the fluid control unit in accordance with an eighteenth embodiment of the present disclosure, FIG. 11(*e*) is a schematic of a fluid control unit which is a specific implementation of the fluid control unit in accordance with a nineteenth embodiment of the present disclosure.
Figure 11B:
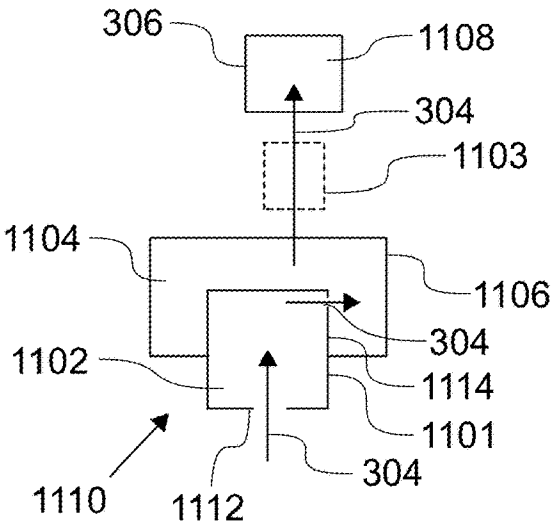
Figure 11A:
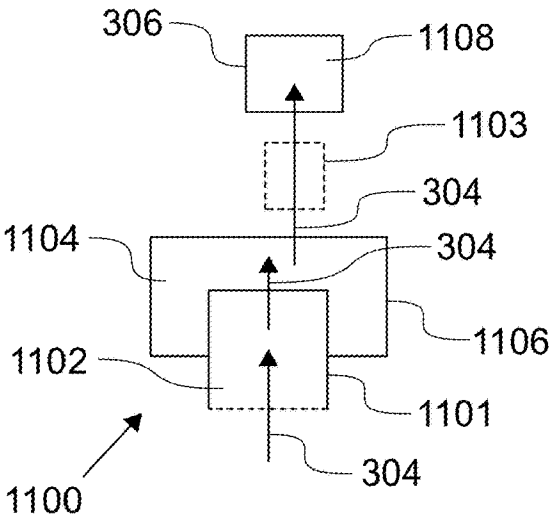
Figure 11E:
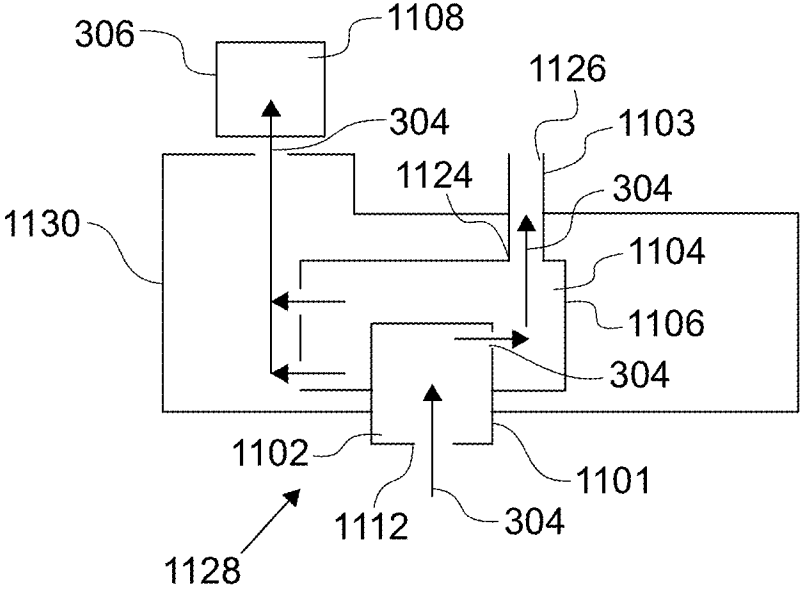
Figure 11D:
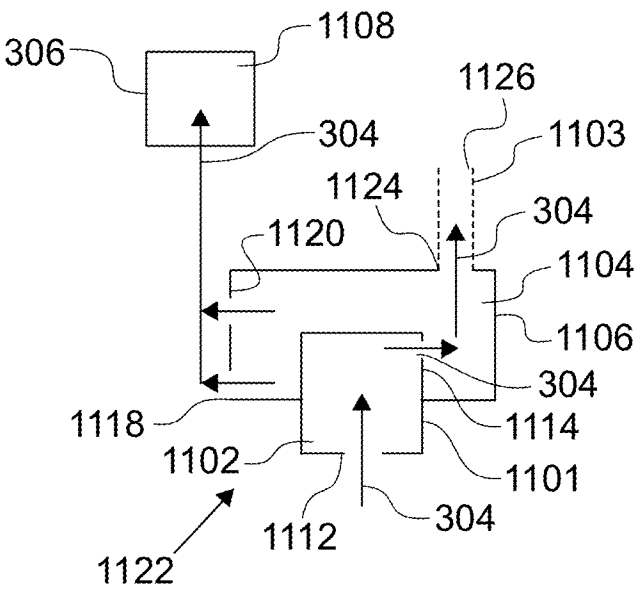
Figure 12B:
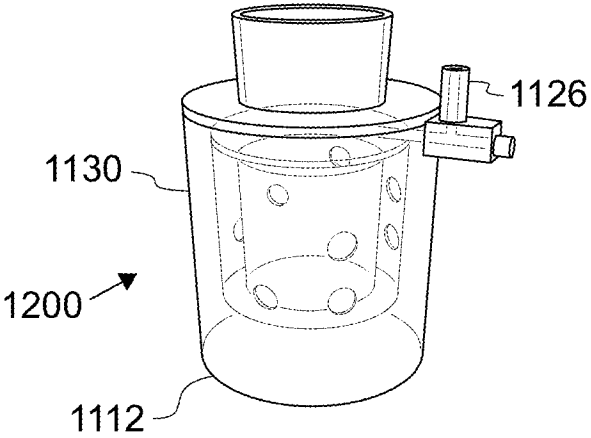
FIG. 12(*a*) is a schematic of a fluid control unit in accordance with a twentieth embodiment of the present disclosure, FIG. 12(*b*) is a schematic of an X-ray view of the fluid control unit, FIG. 12(*c*) is a schematic showing a sectional view of the fluid control unit, and FIG. 12(*d*) is a photograph of 3D printed parts which can be used to construct the fluid control unit.
Figure 12D:
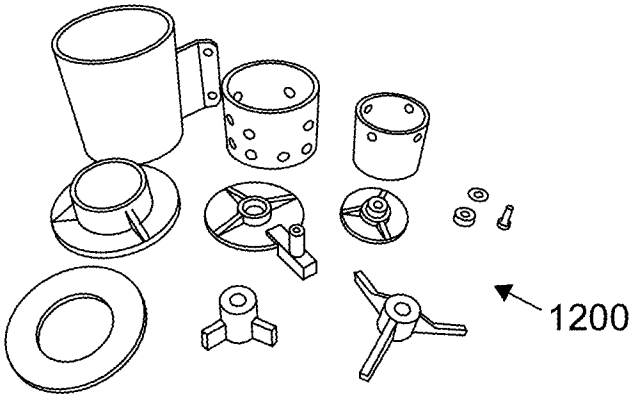
Figure 12A:
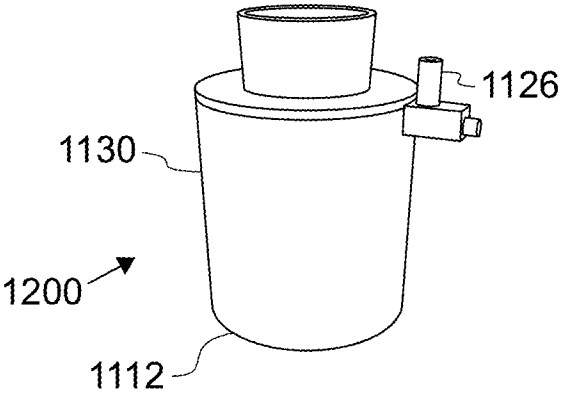
Figure 12C:
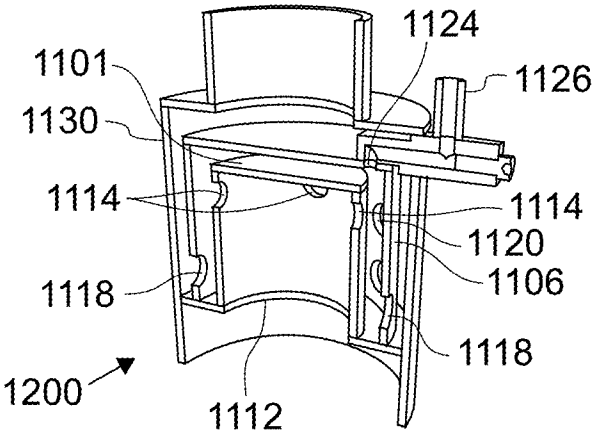

FIG. 9(*a*) is a schematic of the apparatus 808 in situ. FIG. 9(*b*) is a schematic of the apparatus 808 in situ, with a large influx of hydrocarbons.

FIG. 10(*a*) is a schematic of a specific implementation of the fluid control unit 308 in accordance with a fourteenth embodiment of the present disclosure. FIG. 10(*b*) is a schematic of an X-ray view of the specific implementation of the fluid control unit 308, FIG. 10(*c*) is a schematic showing a sectional view of the specific implementation of the fluid control unit 308, and FIG. 10(*d*) is a photograph of a 3D printed part of the specific implementation of the fluid control unit 308.

The specific implementation presented in FIG. 10(*a*)-(*d*) is suitable for 3D printing and uses a simplified geometry that utilises the key features of the s-bend approach as discussed previously.

FIG. 11(*a*) is a schematic of a fluid control unit 1100 which is a specific implementation of the fluid control unit 308 in accordance with a fifteenth embodiment of the present disclosure. The fluid control unit 1100 comprises a first unit 1101 enclosing a first volume 1102 and arranged to capture the volume of fluid 304 within the first volume 1102 and to provide the volume of fluid 304 to a second volume 1104.

The fluid control unit 1100 comprises a second unit 1106 at least partially enclosing the first unit 1101 and enclosing the second volume 1104. The second unit 1106 is arranged to provide the volume of fluid 304 from the second volume 1104 to a third volume 1108. However, the fluid control unit 1100 is configured to restrict the passage of the volume of fluid 304 to the third volume 1108 until the flow rate of the volume of fluid 304 exceeds the threshold value.

In operation, the detection unit 306 functions to detect the presence of the predetermined chemical 302 within the third volume 1108. The detection unit 306 may function as described in relation to any of the embodiments described herein.

The dashed line shown on the unit 1101 represents an opening that can permit the passage of the volume of fluid 304, however the first volume 1102 is still maintained within the enclosed space formed by the dashed line and the sides of the unit 1101. It will be appreciated that other embodiments may have the opening positioned in a different location, having a different size, or coupled to a conduit or similar passage for fluid.

In the present embodiment the second volume 1104 is exterior to the first unit 1101. In the present embodiment, the third volume 1108 is exterior to both the first and second units 1101, 1102. One or both of the units 1101, 1102 may be substantially cylindrical.

The fluid control unit 1100 may comprise a flow restriction component 1103 arranged to restrict the passage of the volume of fluid 304 to the third volume 1108 until its flow rate exceeds the threshold value.

FIG. 11(*b*) is a schematic of a fluid control unit 1110 which is a specific implementation of the fluid control unit 1100 in accordance with a sixteenth embodiment of the present disclosure. The fluid control 1110 comprises an orifice 1112 to permit the passage of the volume of the fluid 304 from an exterior of the first unit 1101 to the first volume 1102, thereby capturing the volume of fluid 304 within the first volume 1102. The fluid control unit 1110 further comprises an orifice 1114 arranged to permit the passage of the volume of the fluid 304 from the first volume 1102 to the second volume 1104, thereby redirecting the flow of the volume of fluid 304. The position of the orifice 1114 on the first unit 1101 may be adjustable. For example, the first unit 1101 may be configured to permit the adjustment of the position of the orifice 1114 on the first unit 1101.

FIG. 11(*c*) is a schematic of a fluid control unit 1116 which is a specific implementation of the fluid control unit 1110 in accordance with a seventeenth embodiment of the present disclosure. The second unit 1106 comprises an orifice 1118 arranged to permit the passage of the volume of fluid 304 from the second volume 1104 to the third volume 1108, thereby redirecting the flow of the volume of fluid 304. The orifice 1118 may be at a greater depth than the orifice 1114 when in use. The position of the orifice 1118 on the second unit 1106 may be adjustable. For example, the second unit 1106 may be configured to permit the adjustment of the position of the orifice 1118 on the second unit 1106.

The second unit 1106 may comprise an orifice 1120 arranged to permit the passage of the volume of the fluid 304 from the second volume 1104 to the third volume 1108, thereby redirecting the flow of the volume of fluid. The orifice 1118 may be at a greater depth than the orifice 1120 when in use. The position of the orifice 1120 on the second unit 1106 may be adjustable. For example, the second unit 1106 may be configured to permit the adjustment of the position of the orifice 1120 on the second unit 1106.

FIG. 11(*d*) is a schematic of a fluid control unit 1122 which is a specific implementation of the fluid control unit 1116 in accordance with an eighteenth embodiment of the present disclosure.

In the present embodiment the second unit 1106 comprises the flow restriction component 1103. The flow restriction component 1103 comprises an aperture 1124 to provide a fluid passage from the second volume 1104 of the fluid control unit 1122 to an exterior of the fluid control unit 1122, thereby permitting the passage of at least a portion of the volume of the fluid 304 to the exterior of the fluid control unit 1122.

The flow restriction component 1103 may comprise a conduit 1126 coupled to the aperture 1124 to provide the fluid passage from the second volume 1104 of the fluid control unit 1122 to the exterior of the fluid control unit 1122, thereby permitting the passage of at least a portion of the volume of the fluid 304 to the exterior of the fluid control unit 1122.

The threshold value may be dependent on the size of the aperture 1124 and/or the conduit 1126. The size of the aperture 1124 and/or the conduit 1126 may be adjustable. The orifice 1118 and/or the orifice 1120 may be positioned at a greater depth than the aperture 1124 and/or an outlet of the conduit 1126 when in use.

FIG. 11(*e*) is a schematic of a fluid control unit 1128 which is a specific implementation of the fluid control unit 1122 in accordance with a nineteenth embodiment of the present disclosure. The fluid control unit 1128 comprises a third unit 1130 partially enclosing the first unit 1101 and enclosing the second unit 1106. Further embodiments may have the third unit 1130 at least partially enclosing the first unit 1101 and/or at least partially enclosing the second unit 1106.

In the present embodiment, the third unit is arranged to direct the flow of the volume of fluid 304 upwards when in use, such that the volume of fluid 304 is directed towards the third volume 1108 where it can contact the detection unit 306.

FIG. 12(*a*) is a schematic of a fluid control unit 1200 in accordance with a twentieth embodiment of the present disclosure. The fluid control unit 1200 is a specific implementation of the fluid control unit 308 and shares features with the fluid control units as described in FIGS. 11(*a*)-11(*e*).

FIG. 12(*b*) is a schematic of an X-ray view of the fluid control unit 1200, FIG. 12(*c*) is a schematic showing a sectional view of the fluid control unit 1200, and FIG. 12(*d*) is a photograph of 3D printed parts which can be used to construct the fluid control unit 1200.

In FIG. 12(*c*) the apparatus 1200 is shown to comprise multiple orifices 1118 and multiple orifices 1114. The orifices 1114 and the orifices 1118 provide the same function as their respective single orifices as described in previous embodiments. Similarly, there may be multiple orifices 1120 in further embodiments.

The apparatus 1200 presented in FIGS. 12(*a*)-12(*d*) is suitable for multi-part 3D printing (as illustrated by the component parts presented in FIG. 12(*d*)) or by other machining or fabrication techniques. This enables easy "swapping-out" of internal parts. The apparatus 1200 uses concentric cylindrical elements to provide a compact and robust structure.

Figure 13B:
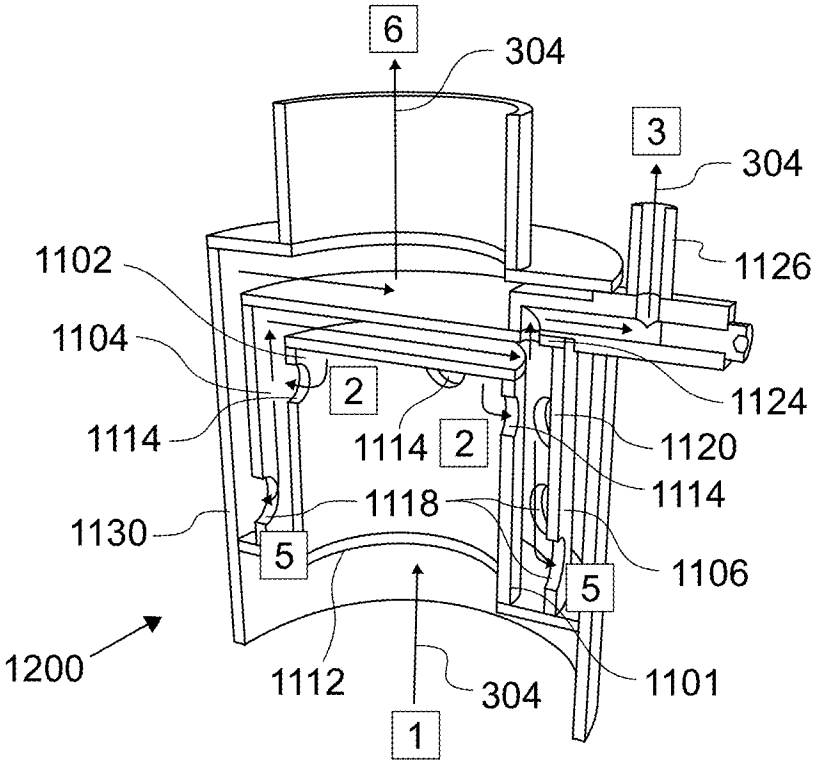
FIG. 13(*a*) is a schematic showing a sectional view of the fluid control unit in operation, FIG. 13(*b*) is a further schematic showing a sectional view of the fluid control unit in operation.
Figure 13A:
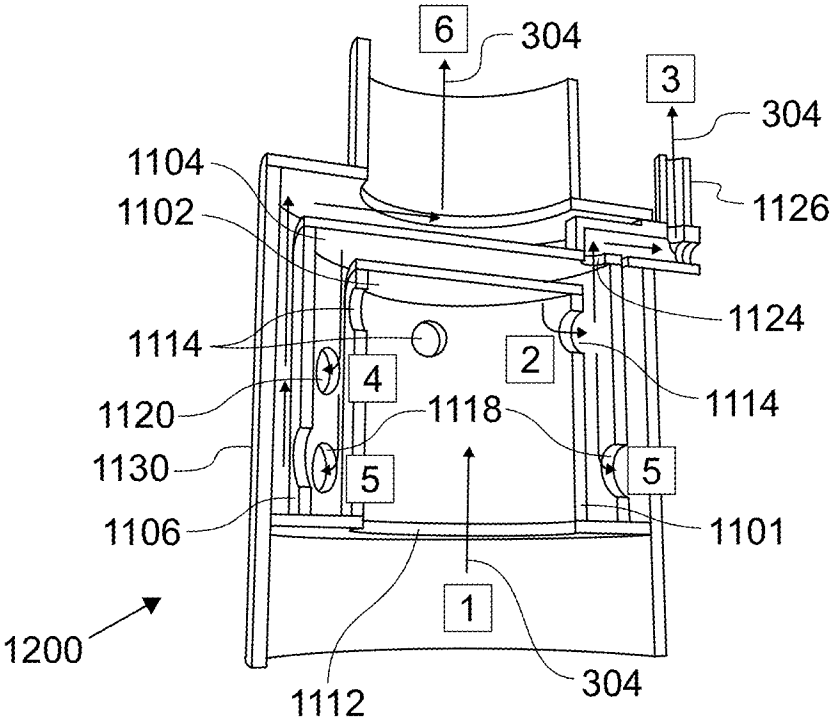
Figure 14B:
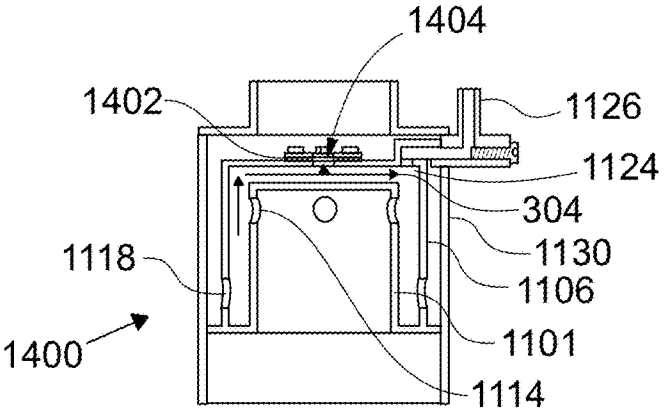
FIG. 14(*a*) is a schematic of a fluid control unit in accordance with a twenty first embodiment of the present disclosure, FIG. 14(*b*) is an alternative schematic of the fluid control unit, FIG. 14(*c*) is a schematic of the fluid control unit after degradation of the plug, FIG. 14(*d*) is an alternative schematic of the fluid control unit after degradation of the plug.
Figure 14D:
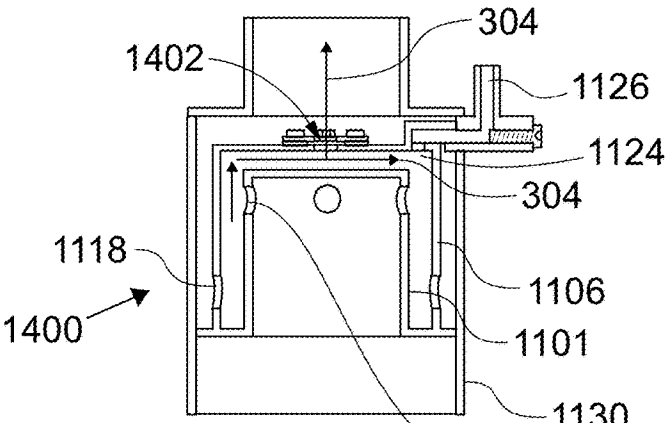
Figure 14A:
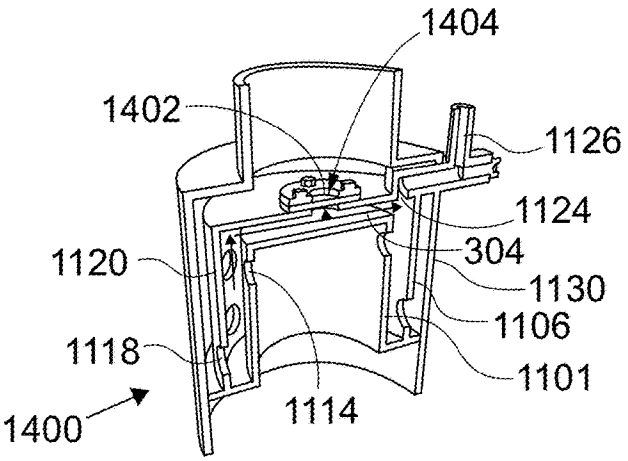
Figure 14C:
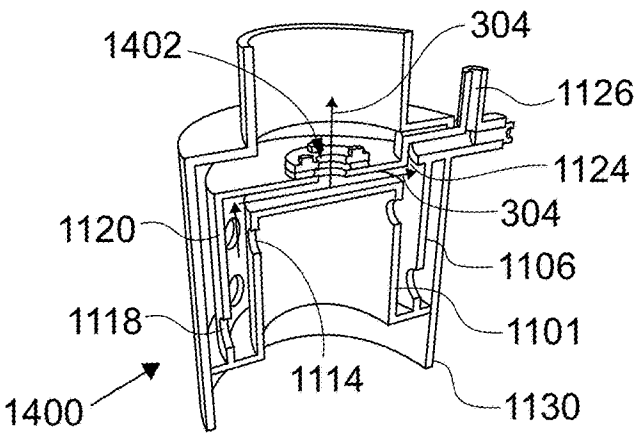

FIG. 13(*a*) is a schematic showing a sectional view of the fluid control unit 1200 in operation. FIG. 13(*b*) is a further schematic showing a sectional view of the fluid control unit 1200 in operation.

FIGS. 13(*a*) and 13(*b*) include labels from 1 to 6 denoting different steps in the operation of the apparatus 1200. The operation is as follows:

1. The volume of fluid 304, which is a gas in the present embodiment, is captured by the first unit 1101 via the orifice 1112.
2. The volume of fluid 304 builds up against the top of the first unit 1101 until the level of gas descends to the vents provided by the orifices 1114 which enables the volume of fluid 304 to pass from the first volume 1102 into the second volume 1104. The second volume 1104 is provided by the first annular space formed by the second unit 1106 enclosing the first unit 1101.
3. A proportion of flow of the volume of fluid 304 from the orifices 1114 vents through ports at the top of the first annular space and out through the snorkel affixed to the exhaust (as provided by the orifice 1124 and the conduit 1126).
4. With a sufficiently high inflow rate (when the flow rate exceeds the threshold value), the volume of fluid 304 is unable to vent through the orifice 1124 and the conduit 1126 at a suitable rate, and builds up against the top surface of the second unit 1106 until the gas descends to the orifice 1120 and passes through to the second annular space provided by the third unit 1130 enclosing the second unit 1106. As discussed previously, the flow restriction component 1103 comprises the aperture 1124 and the conduit 1126.
5. At a very high inflow rate, gas may further descend to the lower set of vents, as provided by the orifices 1118 and pass through to the second annular space.
6. All gas that has entered the second annular space rises to vent through the main exhaust and up to the reaction chamber as provided by the detection unit 306.

By adjusting the number, size and/or placement of one or more of the orifices 1114, 1118, 1120, 1124 and/or the conduit 1126 the proportion of gas allowed into or prevented from entering the reaction chamber is controllable.

FIG. 14(*a*) is a schematic of a fluid control unit 1400 in accordance with a twenty first embodiment of the present disclosure. FIG. 14(*b*) is an alternative schematic of the fluid control unit. The fluid control unit 1400 is configured to restrict the passage of the volume of fluid 304 to the third volume 1108 via a first path until the flow rate of the volume of fluid 304 exceeds the threshold value The first path is provided by the orifices 1118, 1120. In further embodiments, the first path may be provided by one of these orifices, more than one where there are multiple orifices, or all orifices 1118, 1120, in accordance with the understanding of the skilled person.

The fluid control unit 1400 is configured to provide the volume of fluid 304 to the third volume 1108 via a second path if the quantity of the first predetermined chemical 302 passing through at least a portion of the fluid control unit 1400 exceeds a threshold quantity.

In the present embodiment, the fluid control unit 1400 comprises an orifice 1402, which provides the second path. The orifice 1402 is closed by a plug 1404 that degrades in the presence of the first predetermined chemical 302.

In the present example, the plug 1404 is arranged to degrade to a sufficient degree to permit passage of the volume of fluid 304 into the third volume 1108 via the orifice 1402 when the quantity of the first predetermined chemical 302 passing through and contacting the plug 1404 exceeds the threshold quantity.

In the present embodiment, the second unit 1106 comprises the orifice 1402 and the plug 1404. Specifically, the orifice 1402 and the plug 1404 are in an upper surface of the second unit 1404.

It will be appreciated that in further embodiments, components of the fluid control unit 1400 may be modified in accordance with the understanding of the skilled person. For example, the third unit 1130 may be omitted, with the orifice 1402 and plug 1404 being implemented in one of the systems as presented in FIGS. 11(*a*)-11(*d*).

The first predetermined chemical 302 may be a liquid hydrocarbon such as oil. The volume of fluid 304 may comprise a second predetermined chemical such as a gas hydrocarbon. In further embodiments, the second predetermined chemical may be, for example, carbon dioxide or hydrogen. The plug 1404 may be configured such that it does not degrade substantially, or at all, in the presence of the second predetermined chemical.

FIG. 14(*c*) is a schematic of the fluid control unit 1400 after degradation of the plug 1404. FIG. 14(*d*) is an alternative schematic of the fluid control unit 1400 after degradation of the plug 1404.

In operation of the overall apparatus, including one of the detectors 306 as described herein, and where the fluid control unit 1400 is used, the first material 324 may be sensitive to oil, such that oil is the first predetermined chemical 302.

In operation, there may be a release of gas (the second predetermined chemical) prior to or concurrent to the release of the oil. It is desirable to ignore the release of the gas as it may not be representative of a failure of the subsea well, whilst still detecting the presence of oil. The fluid control unit 1400 can function to ignore the gas but allow the oil to be diverted into the reaction chamber provided by the detector 306 and positioned above the fluid control unit 1400.

In operation, the plug 1404 closes the aperture 1402 and is unaffected by the passage of the second predetermined chemical (the gas) moving underneath it. If oil (the first predetermined chemical) enters the flow of the volume of fluid 304, but is of insufficient flow rate to be directed to the reaction chamber via the first path, or is entrained within the flow of gas and is passed to the aperture 1124 and conduit 1126 then it will begin to degrade the plug 1404. Once a sufficient quantity of oil has interacted with the plug 1404, the plug will fail, thereby allowing direct passage of the volume of fluid 304 to the reaction chamber, where the detector 306 will behave in accordance with one of the embodiments as discussed herein.

It will be appreciated that the fluid control units as described in FIGS. 11(*a*)-11(*e*), 12(*a*)-(*d*), 13(*a*)-13(*d*) and 14(*a*)-(*d*) may be applied in areas other than in the monitoring of the integrity of subsea wells or fluid sequestration sites and/or without the inclusion of the detector 306. These fluid control units act to restrict the flow of the volume of a fluid until its flow rate exceeds a threshold value which can be applied in any area where it is desirable to control the flow of a volume of fluid based on its flow rate. In such applications, the fluid control units as described provide a compact and robust system for controlling the flow of a fluid, for example, by having the second unit at least partially enclosing the first unit. Other advantages as previously described in relation to the use of the fluid control units in the field of subsea well monitoring are also applicable in other fields, in accordance with the understanding of the skilled person.

FIG. 15 is a table showing results from an analysis of apparatus 808 as presented in FIGS. 9(*a*) and 9(*b*). The analysis results have been extracted from simulations relating to a practical implementation of the apparatus 808.

Figure 16:
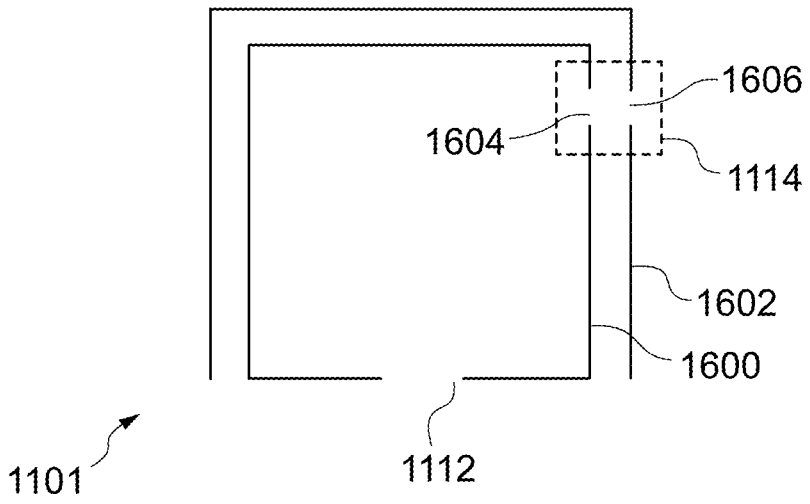
FIG. 16 is a schematic of a specific implementation of the first unit being configured to permit the adjustment of the position of the orifice on the first unit.

FIG. 16 is a schematic of a specific implementation of the first unit 1101 being configured to permit the adjustment of the position of the orifice 1114 on the first unit 1101. It will be appreciated that although illustrated for a single orifice 1114 on the first unit 1101, in further embodiments, the unit 1101 may be modified to permit adjustment of the position of more than one orifice in the unit 1101, in accordance with the understanding of the skilled person.

The first unit 1101 comprises a first inner cylinder 1600 and a first outer cylinder 1602, the first inner cylinder 1600 being positioned at least partially within the first outer cylinder 1602. An outer surface of the first inner cylinder 1600 may be in physical contact with an inner surface of the first outer cylinder 1602.

The first inner cylinder 1600 may comprise a first inner cylinder aperture 1604 and the first outer cylinder 1602 may comprises a first outer cylinder aperture 1606. The apertures 1604, 1606 of the respective cylinders 1600, 1602 may be arranged to partially overlap thereby forming the orifice 1114.

The position at which the apertures 1604, 1606 of the first inner cylinder 1600 and the first outer cylinder 1602 partially overlap may be adjustable, thereby permitting the adjustment of the position of the orifice 1114 on the first unit.

The first inner cylinder 1600 and/or the first outer cylinder 1602 may be configured to be rotatable, where the position of the orifice 1114 is controlled by the relative rotation of the first inner cylinder 1600 and the first outer cylinder 1602.

The first inner cylinder aperture 1604 may be a slot and/or the first outer cylinder aperture 1606 may be a slot.

In a specific embodiment one of the first inner cylinder aperture 1604 and the first outer cylinder aperture 1606 is a vertical slot and the other of the first inner cylinder aperture 1604 and the first outer cylinder aperture 1606 is an angled slot.

Figure 17B:
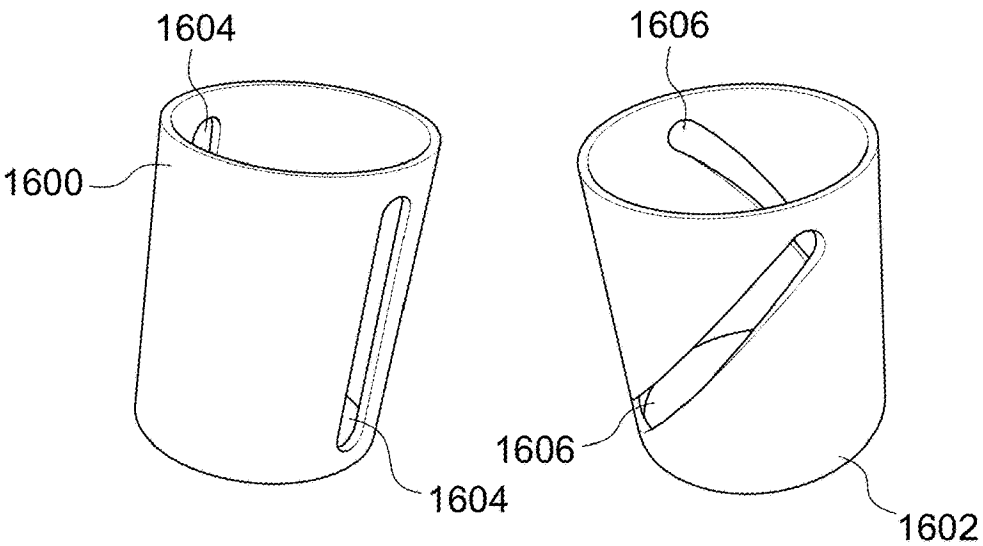
FIG. 17(*a*) is a first schematic of a specific embodiment of the first unit comprising the inner and outer cylinders, FIG. 17(*b*) is a schematic of the specific embodiment of the first unit as shown in FIG. 17(*a*) with the cylinders separated.
Figure 17A:
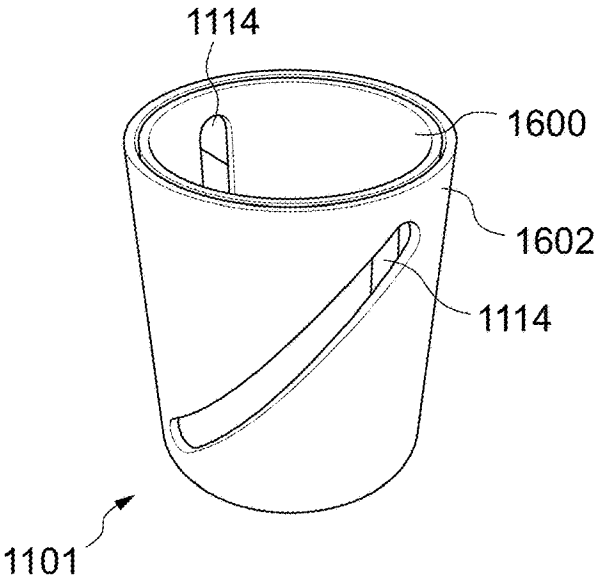
Figure 18A:
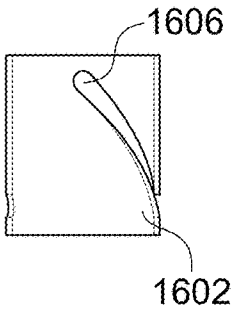
FIG. 18(*a*) is a schematic of a cross section of the outer cylinder.
Figure 18B:
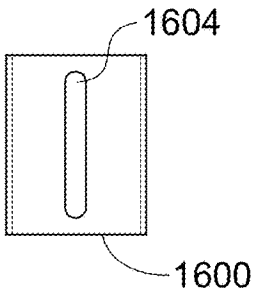
Figure 18C:
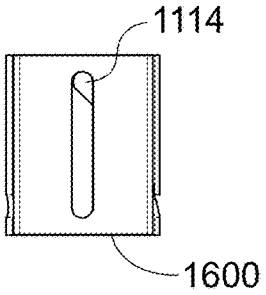
Figure 18D:
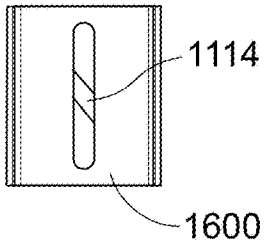
Figure 18E:
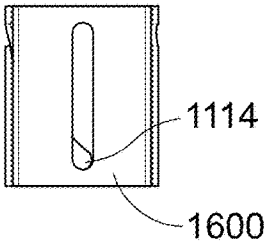
Figure 18F:
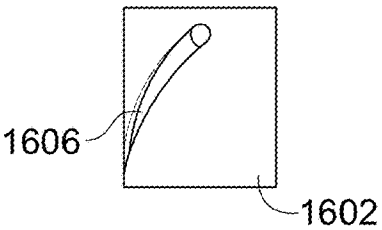
Figure 18G:
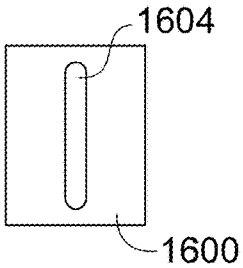
Figure 18H:
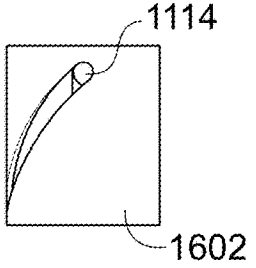
Figure 18I:
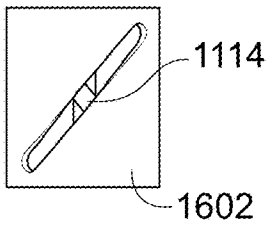
Figure 18J:
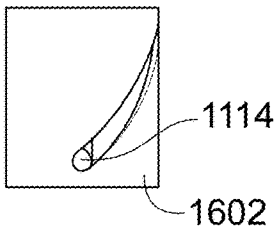
Figure 19B:
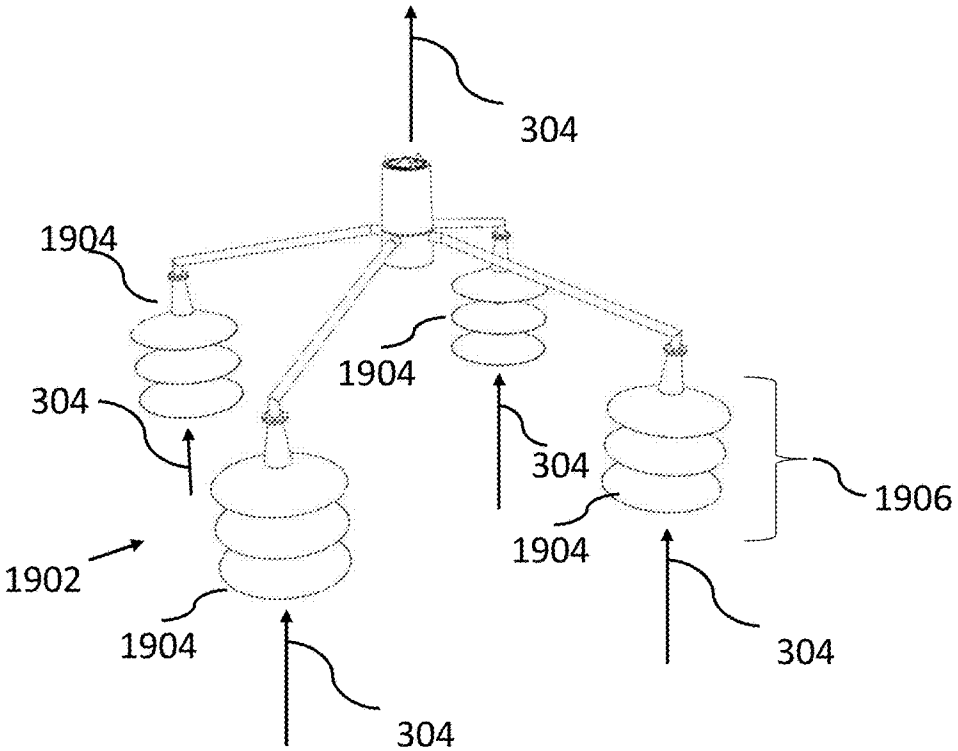
FIG. 19(*a*) is a schematic of an apparatus for monitoring the integrity of a subsea well or a fluid sequestration site in accordance with a twenty second embodiment of the present disclosure, FIG. 19(*b*) is a schematic of a specific embodiment of the fluid collection unit of FIG. 19(*a*), FIG. 19(*c*) is a schematic of a subsea well, FIG. 19(*d*) shows a specific embodiment of the fluid collection unit of FIG. 19(*b*) attached to the subsea well, FIG. 19(*e*) is a schematic showing a side view of the fluid collection unit, FIG. 19(*f*) is a schematic of a cross section of the fluid collection unit, FIG. 19(*g*) is a schematic of a top-down view of the fluid collection unit.
Figure 19A:
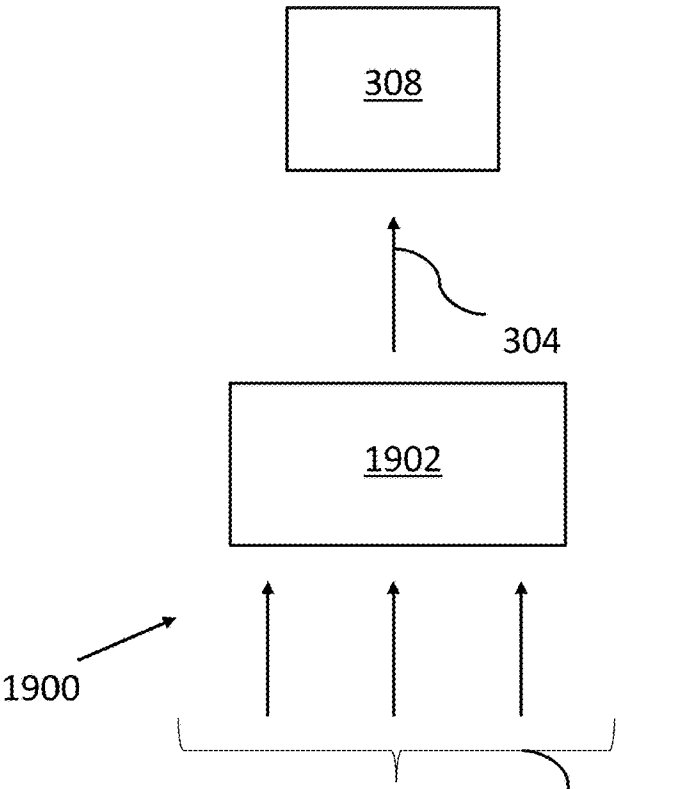
Figure 19D:
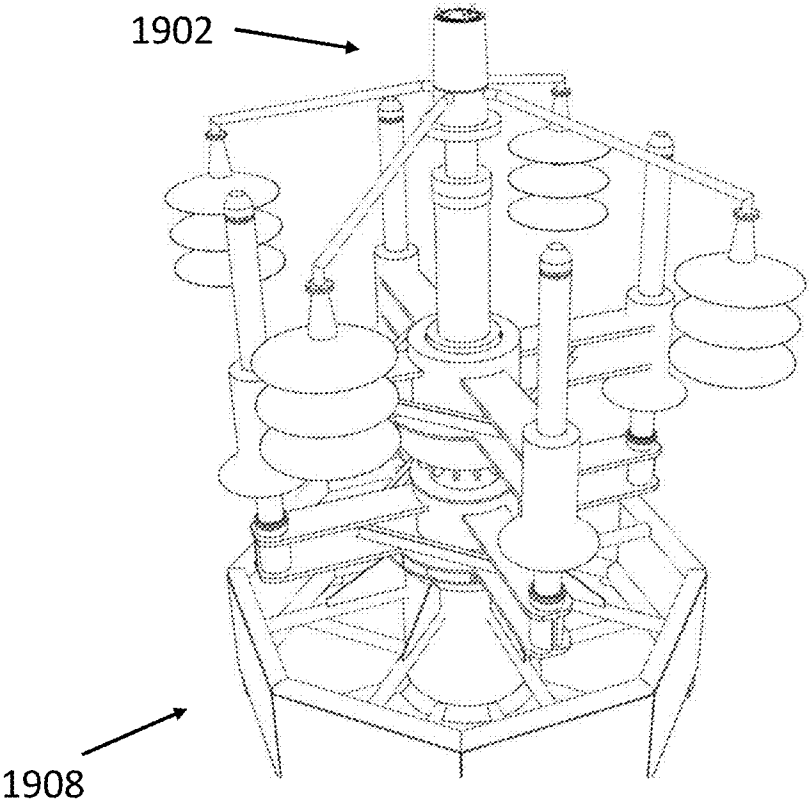
Figure 19C:
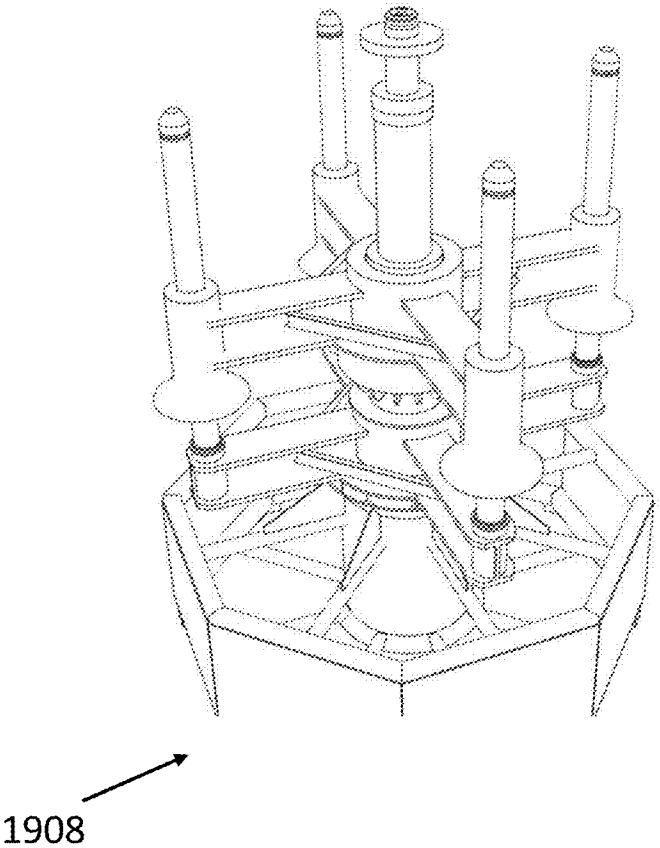
Figure 19G:
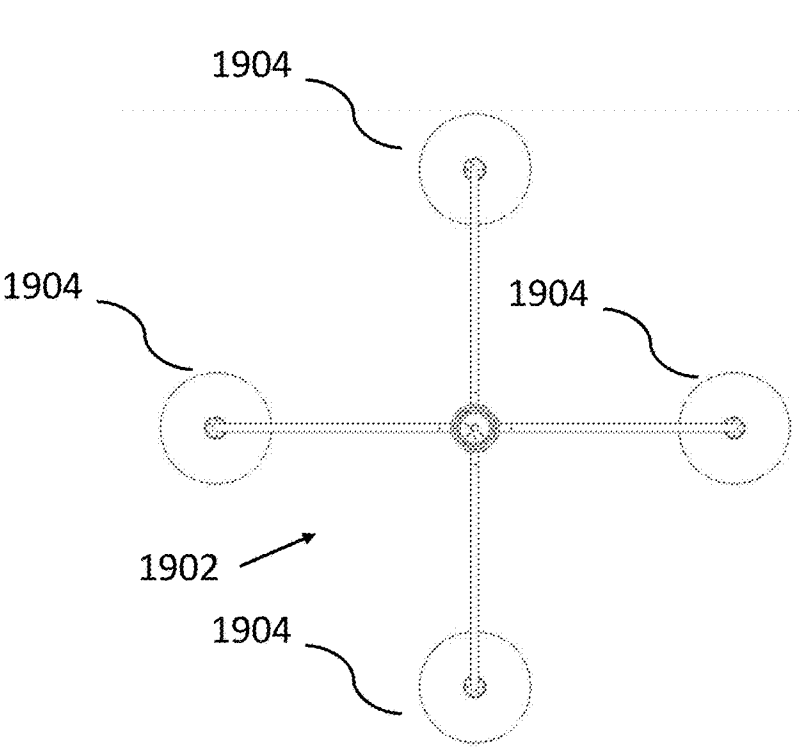
Figure 19E:
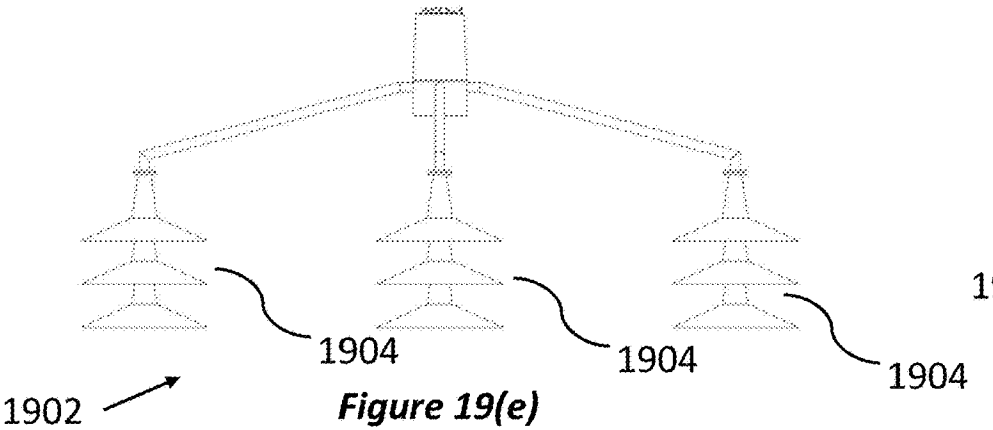
Figure 19F:
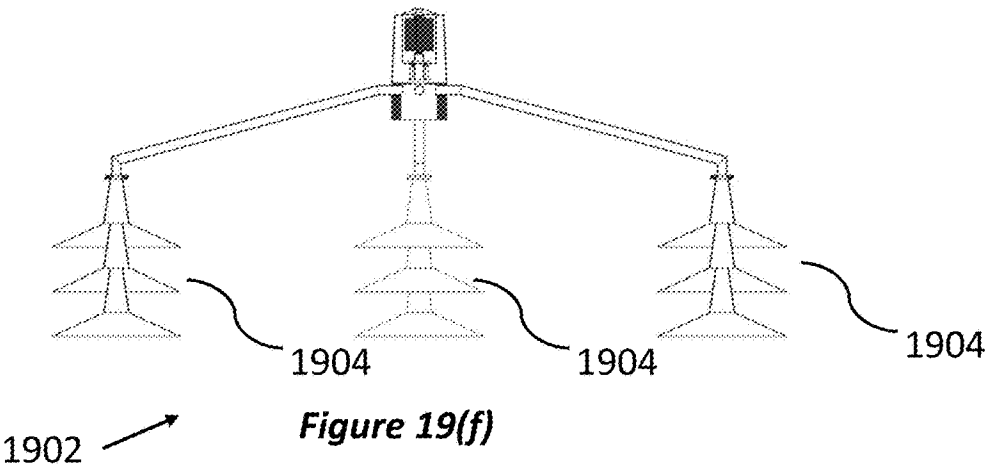

FIG. 17(*a*) is a first schematic of a specific embodiment of the first unit 1101 comprising the inner and outer cylinders 1600, 1602 showing the first inner cylinder 1600 positioned within the first outer cylinder 1602. It can be seen that two apertures 1604 and two apertures 1604 are provided thereby providing two adjustable orifices 1114.

FIG. 17(*b*) is a schematic of the specific embodiment of the first unit 1101 as shown in FIG. 17(*a*) with the cylinders 1600, 1602 separated.

FIG. 18(*a*) is a schematic of a cross section of the cylinder 1602, FIG. 18(*b*) is a schematic of a cross section of the cylinder 1600, FIG. 18(*c*) is a schematic of a cross section of the inner and outer cylinders 1600, 1602 showing a relative rotational configuration providing the orifice 1114 at a first position, FIG. 18(*d*) is a schematic of a cross section of the inner and outer cylinders 1600, 1602 showing a relative rotational configuration providing the orifice 1114 at a second position, FIG. 18(*e*) is a schematic of a cross section of the inner and outer cylinders 1600, 1602 showing a relative rotational configuration providing the orifice 1114 at a third position.

FIG. 18(*f*) is a schematic of a side profile view of the cylinder 1602, FIG. 18(*g*) is a schematic of a side profile of the cylinder 1600, FIG. 18(*h*) is a schematic of a side profile view of the inner and outer cylinders 1600, 1602 showing a relative rotational configuration providing the orifice 1114 at the first position, FIG. 18(*i*) is a schematic of a side profile view of the inner and outer cylinders 1600, 1602 showing a relative rotational configuration providing the orifice 1114 at the second position, FIG. 18(*j*) is a schematic of a side profile view of the inner and outer cylinders 1600, 1602 showing a relative rotational configuration providing the orifice 1114 at the third position.

It will be appreciated that in further embodiments, the second unit 1106 may comprise an inner and outer cylinder, and have one or more of the above-described features relating to the embodiments of the first unit 1101 as presented in FIGS. 16 and 17, to permit adjustment of the position of the orifice 1118 and/or the orifice 1120.

FIG. 19(*a*) is a schematic of an apparatus 1900 for monitoring the integrity of a subsea well or a fluid sequestration site in accordance with a twenty second embodiment of the present disclosure. The apparatus 1900 comprises a fluid collection unit 1902 that is configured to collect the volume of fluid 304 and to provide the volume of fluid 304 to the fluid control unit 308. It will be appreciated that the fluid control unit 308 may be implemented using any of the fluid control unit embodiments as described herein, and in accordance with the understanding of the skilled person. The fluid control unit 308 may be used with the detection unit 306, for example, as described in FIG. 2(*a*).

FIG. 19(*b*) is a schematic of a specific embodiment of the fluid collection unit 1902. The fluid collection unit 1902 may comprise two or more collection components arranged to collect fluid over different areas. In the present embodiment there are four fluid collection components 1904 arranged around a central point. In the present embodiment, the fluid collection components 1904 direct the collected fluid 304 to the central point, with the total volume of fluid 304 then being passed upward to the fluid control unit 308 (not shown) during operation.

The volume of fluid 304 provided to the fluid control unit 308 is the total fluid collected over the different areas by the collection components 1904.

At least one collection component 1904 may comprise one or more funnels 1906, the one or more funnels being arranged to collect fluid over an area and to funnel the fluid into a smaller area. In the present embodiment, each collection component 1904 comprises three conical funnels 1906.

The fluid collection unit 1902 may be attachable to the subsea well. FIG. 19(*c*) is a schematic of a subsea well 1908. FIG. 19(*d*) shows a specific embodiment of the fluid collection unit 1902 where the fluid collection unit 1902 is attachable, and presently attached, to the subsea well 1908.

The use of the fluid collection unit 1902 enables the collection of the volume of fluid 304 over a large area thereby improving detection efficiency of subsea well leaks.

FIG. 19(*e*) is a schematic showing a side view of the fluid collection unit 1902. FIG. 19(*f*) is a schematic of a cross section of the fluid collection unit 1902. FIG. 19(*g*) is a schematic of a top-down view of the fluid collection unit 1902.

Common features between Figures share common reference numerals or variables.

Various improvements may be made to the above without departing from the scope of the disclosure.

We claim:

1. An apparatus for monitoring the integrity of a subsea well or a fluid sequestration site by detecting the presence of a first predetermined chemical in a volume of fluid when the volume of fluid is being released at a flow rate in excess of a threshold value, the apparatus comprising:

a detection unit configured to detect the first predetermined chemical; and a fluid control unit configured to:

i) capture the volume of fluid;

ii) direct the volume fluid to the detection unit; and iii) restrict the flow of the volume of fluid to the detection unit until its flow rate exceeds a threshold value, wherein fluid control unit comprises:

i) an input portion arranged to capture the volume of fluid;

ii) an output portion arranged to provide the volume of fluid to the detection unit; and iii) a fluid path portion positioned therebetween, the fluid path portion being arranged to direct the volume of fluid from the input portion to the output portion;

wherein:

the fluid path portion comprises a flow restriction component to restrict the flow of the volume of fluid to the detection unit until its flow rate exceeds the threshold value.

2. The apparatus of claim 1, wherein the detection unit is configured to detect the first predetermined chemical by reacting to contact with the first predetermined chemical, and the detection unit is configured to activate the signalling device in response to the detection of the first predetermined chemical.

3. The apparatus of claim 1, wherein:

the fluid control unit comprises:

i) an input portion arranged to capture the volume of fluid;

ii) an output portion arranged to provide the volume of fluid to the detection unit; and iii) a fluid path portion positioned therebetween, the fluid path portion being arranged to direct the volume of fluid from the input portion to the output portion.

4. The apparatus of claim 3, wherein the fluid path portion comprises a flow restriction component to restrict the flow of the volume of fluid to the detection unit until its flow rate exceeds the threshold value.

5. The apparatus of claim 4, wherein the flow restriction component comprises an aperture to provide a fluid passage from an interior of the fluid control unit to an exterior of the fluid control unit, thereby permitting the passage of at least a portion of the volume of fluid from the interior of the fluid control unit to the exterior of the fluid control unit.

6. The apparatus of claim 5, comprising a first conduit, wherein:

an aperture is coupled to the first conduit thereby providing the fluid passage from the interior of the fluid control unit to the exterior of the fluid control unit; and a first end of the first conduit at the aperture is at a first depth, and a second end of the first conduit is at a second depth; and the second depth is less than the first depth.

7. The apparatus of claim 3, wherein:

the fluid path portion comprises a first portion, a second portion and a flow redirect portion; and the fluid path portion is arranged to provide a main fluid path from the input portion to the first portion, from the first portion to the flow redirect portion, from the flow redirect portion to the second portion, and from the second portion to the output portion.

8. The apparatus of claim 7, wherein:

the flow redirect portion is arranged to redirect the main fluid path; and the fluid path portion comprises an s-bend comprising the first portion, the second portion and the flow redirect portion; and the fluid path portion comprises a flow restriction component to restrict the flow of the volume of fluid to the detection unit until its flow rate exceeds the threshold value.

9. The apparatus of claim 7, wherein the detection unit comprises one or more vents arranged to permit the passage of fluids; and the flow redirect portion and the second portion are coupled via at least one orifice to provide an additional fluid path between the flow redirect portion and the second portion.

10. The apparatus of claim 1, wherein the fluid control unit comprises:

a first unit enclosing a first volume and arranged to capture the volume of fluid within the first volume and to provide the volume of fluid to a second volume; and a second unit at least partially enclosing the first unit and enclosing the second volume and arranged to provide the volume of fluid from the second volume to a third volume; wherein:

the fluid control unit is configured to restrict the passage of the volume of fluid to the third volume until the flow rate of the volume of fluid exceeds a threshold value; and the detection unit is configured to detect the presence of the first predetermined chemical within the third volume.

11. A method of monitoring the integrity of a subsea well or a fluid sequestration site, the method comprising:

i) capturing a volume of fluid being released by the subsea well or the fluid sequestration site, using an input portion of a fluid control unit;

ii) providing the volume fluid to a detection unit, using an output portion of the fluid control unit;

iii) directing the volume of fluid from the input portion to the output portion using a fluid path portion of the fluid control unit positioned between the input portion and the output portion; and iv) restricting the flow of the volume of fluid to the detection unit until its flow rate exceeds a threshold value, using a flow restriction component of the fluid path portion.

12. An apparatus for monitoring the integrity of a subsea well or a fluid sequestration site, the apparatus comprising a fluid control unit for restricting the flow of a volume of fluid until its flow rate exceeds a threshold value, the fluid control unit comprising:

a first unit enclosing a first volume and arranged to capture the volume of fluid within the first volume and to provide the volume of fluid to a second volume; and a second unit at least partially enclosing the first unit and enclosing the second volume and arranged to provide the volume of fluid from the second volume to a third volume; wherein:

the fluid control unit is configured to restrict the passage of the volume of fluid to the third volume until the flow rate of the volume of fluid exceeds a threshold value; and wherein:

the fluid control unit comprises a flow restriction component arranged to restrict the passage of the volume of fluid to the third volume until its flow rate exceeds the threshold value.

13. The apparatus of claim 12, wherein:

the second volume is exterior to the first unit; and the third volume is exterior to the first unit and the second unit; and one or both of the first and second units are substantially cylindrical; and the first unit comprises:

i) a first orifice arranged to permit the passage of the volume of fluid from an exterior of the first unit to the first volume, thereby capturing the volume of fluid within the first volume; and ii) a second orifice arranged to permit the passage of the volume of the fluid from the first volume to the second volume, thereby redirecting the flow of the volume of fluid.

14. The apparatus of claim 12, wherein the fluid control unit comprises a flow restriction component arranged to restrict the passage of the volume of fluid to the third volume until its flow rate exceeds the threshold value.

15. The apparatus of claim 14, wherein:

the second unit comprises the flow restriction component;

the flow restriction component comprises an aperture to provide a fluid passage from the second volume of the fluid control unit to an exterior of the fluid control unit, thereby permitting the passage of at least a portion of the volume of the fluid to the exterior of the fluid control unit; and the flow restriction component comprises a conduit coupled to the aperture to provide the fluid passage from the second volume of the fluid control unit to the exterior of the fluid control unit, thereby permitting the passage of at least a portion of the volume of fluid to the exterior of the fluid control unit.

16. The apparatus of claim 12, wherein the fluid control unit is configured to restrict the passage of the volume of fluid to the third volume via a first path until the flow rate of the volume of fluid exceeds a threshold value.

17. The apparatus of claim 16, wherein the fluid control unit is configured to provide the volume of fluid to the third volume via a second path if the quantity of a first predetermined chemical passing through at least a portion of the fluid control unit exceeds a threshold quantity.

18. The apparatus of claim 17, wherein:

the fluid control unit comprises a fifth orifice, the fifth orifice providing the second path;

the fifth orifice is closed by a plug comprising a first material that degrades in the presence of the first predetermined chemical; and the plug is arranged to degrade to a sufficient degree to permit passage of the volume of fluid into the third volume via the fifth orifice when the quantity of the first predetermined chemical passing through and contacting the plug exceeds the threshold quantity.

19. The apparatus of claim 12, wherein the fluid control unit comprises a third unit at least partially enclosing the first unit and at least partially enclosing the second unit.

20. A method of restricting the flow of a volume of fluid until its flow rate exceeds a threshold value as part of a process for monitoring the integrity of a subsea well or a fluid sequestration site, the method comprising:

providing a first unit, a second unit, and a flow restriction component, the second unit at least partially enclosing the first unit;

capturing the volume of fluid within a first volume enclosed by the first unit;

providing the volume of fluid to a second volume enclosed by the second unit;

providing the volume of fluid from the second volume to a third volume; and restricting the passage of the volume of fluid to the third volume until the flow rate of the volume of fluid exceeds a threshold value using the flow restriction component.

* * * * *